US009908667B1

(12) United States Patent
Smith et al.

(10) Patent No.: US 9,908,667 B1
(45) Date of Patent: Mar. 6, 2018

(54) CUP LID WITH RECLOSABLE CAP

(71) Applicant: LBP Manufacturing LLC, Cicero, IL (US)

(72) Inventors: Stephen A. Smith, Naperville, IL (US); Weston Koennecke, Oak Park, IL (US)

(73) Assignee: LBP Manufacturing LLC, Cicero, IL (US)

( * ) Notice: Subject to any disclaimer, the term of this patent is extended or adjusted under 35 U.S.C. 154(b) by 0 days.

(21) Appl. No.: 15/622,968

(22) Filed: Jun. 14, 2017

Related U.S. Application Data

(63) Continuation of application No. 15/393,960, filed on Dec. 29, 2016.
(Continued)

(51) Int. Cl.
*B65D 43/16* (2006.01)
*B65D 43/02* (2006.01)
(Continued)

(52) U.S. Cl.
CPC ..... *B65D 43/16* (2013.01); *A47G 19/2272* (2013.01); *B65D 43/0204* (2013.01);
(Continued)

(58) Field of Classification Search
CPC .... B65D 41/62; B65D 43/16; B65D 43/0204; B65D 51/18; B65D 2251/0021;
(Continued)

(56) References Cited

U.S. PATENT DOCUMENTS 822,318 A 6/1906 Surbrug
1,658,348 A 2/1928 Michael
(Continued)

FOREIGN PATENT DOCUMENTS

EP 0849187 A2 6/1998
EP 1043243 A2 10/2000
(Continued)

OTHER PUBLICATIONS

Notification of Transmittal of the International Search Report and the Written Opinion of the International Searching Authority, or the Declaration from the International Bureau of WIPO for International Application No. PCT/US2015/032343 dated Aug. 14, 2015, 12 pages.

*Primary Examiner* — King M Chu
*Assistant Examiner* — James M Van Buskirk
(74) *Attorney, Agent, or Firm* — Fitch, Even, Tabin & Flannery LLP

(57) ABSTRACT

A cup lid assembly includes a cover and a cap. The cover includes an annular mounting portion that secures the cover to the cup rim, an outer annular side wall, an annular upper ridge, an annular inner sidewall, and an interior portion. The annular upper ridge has a drink opening, and the annular inner sidewall slopes downward and inward from the annular upper ridge toward the interior portion. The cap is removably attachable to the cover and includes a main body arranged to be positioned over the interior portion of the cover and a hinged flap extending from the main body. The hinged flap includes a plug adapted to seal the drink opening. The annular inner sidewall has printed text provided on the sloped surface of the annular inner sidewall opposite the drink opening.

19 Claims, 13 Drawing Sheets

Related U.S. Application Data

(60) Provisional application No. 62/419,306, filed on Nov. 8, 2016.

(51) Int. Cl.
*B65D 51/18* (2006.01)
*A47G 19/22* (2006.01)

(52) U.S. Cl.
CPC ..... *B65D 51/18* (2013.01); *B65D 2251/009* (2013.01); *B65D 2251/0021* (2013.01); *B65D 2251/0028* (2013.01); *B65D 2251/0081* (2013.01); *B65D 2543/00046* (2013.01)

(58) Field of Classification Search
CPC .... B65D 2251/0028; B65D 2251/0081; B65D 2251/009; B65D 2543/00046; B65D 5/425; A47G 19/2272
See application file for complete search history.

(56) References Cited

U.S. PATENT DOCUMENTS 1,765,284 A 6/1930 Prosnitz
2,152,600 A 3/1939 Morrison
2,274,752 A 3/1942 Straub
2,304,214 A 12/1942 Straub
2,492,846 A 12/1949 Coyle et al.
2,757,859 A 8/1956 Holland
D242,108 S 11/1976 Dart et al.
4,057,167 A 11/1977 Lee
4,201,320 A 5/1980 Eppenbach
4,232,797 A 11/1980 Waterbury
D259,705 S 6/1981 Bagwell
4,421,244 A 12/1983 Van Melle
D272,794 S 2/1984 Dart
D273,651 S 5/1984 Emrick
D274,983 S 8/1984 Dart et al.
D280,600 S 9/1985 Earl
4,552,522 A 11/1985 Van Melle
4,566,605 A 1/1986 Rogers
4,589,569 A 5/1986 Clements
D285,416 S 9/1986 Dart et al.
4,619,372 A 10/1986 McFarland
4,627,537 A 12/1986 Rogers
4,629,088 A 12/1986 Durgin
D287,919 S 1/1987 Clements
D291,040 S 7/1987 Dart
4,738,373 A 4/1988 DeParales
4,749,099 A 6/1988 Davis et al.
4,760,934 A 8/1988 Netsch
4,881,668 A 11/1989 Kitterman et al.
4,892,234 A 1/1990 Bennett
4,899,902 A 2/1990 DeMars
4,938,379 A 7/1990 Kellner
4,949,865 A 8/1990 Turner
D318,777 S 8/1991 Freese
D323,116 S 1/1992 Dart et al.
5,090,584 A 2/1992 Roberts et al.
5,111,961 A 5/1992 Van Melle
D329,604 S 9/1992 Kuczer
5,197,624 A 3/1993 Dodaro
5,253,781 A 10/1993 Van Melle
D352,899 S 11/1994 Molo
D359,905 S 7/1995 Molo
D364,071 S 11/1995 Lynd
5,490,609 A 2/1996 Lane et al.
5,613,619 A 3/1997 Van Melle
5,624,053 A 4/1997 Freek
5,678,720 A 10/1997 Van Melle
5,699,927 A 12/1997 Lane et al.
5,839,601 A 11/1998 Van Melle
D402,556 S 12/1998 Frye
D405,011 S 2/1999 DeCoster et al.
5,947,323 A 9/1999 Freek et al.
D417,360 S 12/1999 Bickert
D417,845 S 12/1999 Sadlier
5,996,837 A 12/1999 Freek et al.
D424,875 S 5/2000 Husted
6,089,397 A 7/2000 Van Melle
D431,412 S 10/2000 Trombly
D433,596 S 11/2000 Price
D437,223 S 2/2001 Coy
6,220,476 B1 4/2001 Waller
6,250,545 B1 6/2001 Mazzarolo
6,260,727 B1 7/2001 Durdon
D447,412 S 9/2001 Durdon
D460,317 S 7/2002 Price
6,419,105 B1 7/2002 Bruce
6,431,390 B1 8/2002 Waller
6,505,753 B1 1/2003 Freek
D476,566 S 7/2003 Smith et al.
D476,891 S 7/2003 Clarke
D477,223 S 7/2003 Smith et al.
D478,006 S 8/2003 Smith et al.
6,612,456 B1 9/2003 Hundley et al.
D480,698 S 10/2003 Slipy et al.
D480,968 S 10/2003 Atkins et al.
6,644,490 B2 11/2003 Clarke
D485,758 S 1/2004 Clarke
6,679,397 B2 1/2004 Smith et al.
D490,272 S 5/2004 Rohe
6,732,875 B2 5/2004 Smith et al.
D493,718 S 8/2004 Durdon
6,824,003 B1 11/2004 Wong
6,874,649 B2 4/2005 Clarke
6,886,707 B2 5/2005 Giraud
6,889,859 B1 5/2005 Leon
6,889,860 B2 5/2005 Mazzarolo
6,905,044 B1 6/2005 Russo
6,929,143 B2 8/2005 Mazzarolo
7,063,224 B2 6/2006 Clarke et al.
D531,033 S 10/2006 Schmidtner et al.
7,131,551 B2 11/2006 Smith
7,134,566 B2 11/2006 Smith et al.
7,134,569 B2 11/2006 Freek
D533,777 S 12/2006 Hundley et al.
D533,778 S 12/2006 Hollis et al.
D533,779 S 12/2006 Schmidtner et al.
D535,561 S 1/2007 Smith
7,156,251 B2 1/2007 Smith et al.
7,159,732 B2 1/2007 Smith et al.
D536,249 S 2/2007 Smith et al.
7,175,042 B2 2/2007 Durdon
D537,717 S 3/2007 Notarianni
7,185,781 B2 3/2007 Pitts
D539,646 S 4/2007 Hollis et al.
D539,649 S 4/2007 Smith
D539,650 S 4/2007 Smith et al.
D540,165 S 4/2007 Hollis et al.
D540,166 S 4/2007 Hollis et al.
D540,167 S 4/2007 Smith
D540,672 S 4/2007 Hollis et al.
D540,673 S 4/2007 Hollis et al.
D540,674 S 4/2007 Hollis et al.
D540,675 S 4/2007 Hollis et al.
D541,153 S 4/2007 Hollis et al.
D541,650 S 5/2007 Hollis et al.
D541,651 S 5/2007 Hollis et al.
D543,777 S 6/2007 Seum
D544,793 S 6/2007 Hollis et al.
7,246,715 B2 7/2007 Smith et al.
7,246,716 B2 7/2007 Durdon
7,275,653 B2 10/2007 Tedford, Jr.
7,353,582 B2 4/2008 MacKenzie et al.
D570,685 S 6/2008 Koennecke
D570,686 S 6/2008 Hollis et al.
D583,191 S 12/2008 Wong
D584,106 S 1/2009 Wong
D590,662 S 4/2009 Cheng
7,513,382 B2 4/2009 Clarke
7,523,534 B2 4/2009 MacKenzie
D591,595 S 5/2009 Tedford
D592,056 S 5/2009 Tedford

(56) References Cited

U.S. PATENT DOCUMENTS

| | | | | |
|---|---|---|---|---|
| 7,591,389 | B2 | 9/2009 | Wong | |
| 7,591,393 | B2 | 9/2009 | Crudgington | |
| 7,594,584 | B2 | 9/2009 | Durdon | |
| 7,611,029 | B2 | 11/2009 | Wong | |
| 7,641,070 | B2 | 1/2010 | Ho | |
| D611,343 | S | 3/2010 | Miller | |
| 7,676,909 | B2 | 3/2010 | MacKenzie et al. | |
| 7,691,302 | B2 | 4/2010 | Hollis et al. | |
| D614,954 | S | 5/2010 | Crowell et al. | |
| 7,731,047 | B2 | 6/2010 | Ishimitsu | |
| 7,753,224 | B2 | 7/2010 | Cai | |
| D621,659 | S | 8/2010 | Liu | |
| D623,474 | S | 9/2010 | Carlson et al. | |
| D624,413 | S | 9/2010 | Selina et al. | |
| 7,789,260 | B2 | 9/2010 | Hollis et al. | |
| 7,819,271 | B2 | 10/2010 | Hollis et al. | |
| 7,845,509 | B2 | 12/2010 | Burchard | |
| 7,845,510 | B2 | 12/2010 | Schmidtner et al. | |
| 7,850,037 | B2 | 12/2010 | Schmidtner et al. | |
| 7,874,447 | B2 | 1/2011 | Schmidtner et al. | |
| D635,855 | S | 4/2011 | Smith et al. | |
| 7,922,030 | B2 | 4/2011 | Waller | |
| 7,954,659 | B2 | 6/2011 | Zuares et al. | |
| 7,959,029 | B2 | 6/2011 | Whitaker | |
| 7,992,741 | B2 | 8/2011 | Hundley et al. | |
| 8,052,004 | B2 | 11/2011 | Cheng | |
| 8,056,752 | B2 | 11/2011 | Carnevali | |
| 8,113,379 | B2 | 2/2012 | Cai et al. | |
| D655,983 | S | 3/2012 | Cozzolino et al. | |
| D662,362 | S | 6/2012 | Bickert et al. | |
| 8,235,236 | B2 | 8/2012 | Zuares et al. | |
| 8,317,050 | B2 | 11/2012 | Hollis et al. | |
| 8,360,263 | B2 | 1/2013 | D'Amato | |
| 8,631,957 | B2 * | 1/2014 | Dart | B65D 43/0212 220/254.3 |
| 8,794,294 | B2 | 8/2014 | D'Amato | |
| D721,584 | S | 1/2015 | Koennecke | |
| 8,932,428 | B2 | 1/2015 | D'Amato | |
| 2002/0027139 | A1 | 3/2002 | O'Neill | |
| 2002/0038803 | A1 | 4/2002 | Malcolm | |
| 2003/0052127 | A1 | 3/2003 | Mazzarolo | |
| 2003/0089714 | A1 | 5/2003 | Dart et al. | |
| 2003/0089726 | A1 | 5/2003 | Mazzarolo | |
| 2004/0094549 | A1 | 5/2004 | Ryan | |
| 2005/0087539 | A1 | 4/2005 | Waller | |
| 2005/0092748 | A1 | 5/2005 | Durdon | |
| 2005/0269376 | A1 | 12/2005 | Hsieh | |
| 2007/0023442 | A1 | 2/2007 | Auzenne | |
| 2007/0075079 | A1 | 4/2007 | Stokes | |
| 2007/0114236 | A1 | 5/2007 | Shiffer | |
| 2007/0131692 | A1 | 6/2007 | Smith et al. | |
| 2007/0278239 | A1 | 12/2007 | Vogt | |
| 2008/0011762 | A1 | 1/2008 | Boone | |
| 2008/0073343 | A1 | 3/2008 | Shadrach et al. | |
| 2008/0105696 | A1 | 5/2008 | Dart et al. | |
| 2008/0264959 | A1 | 10/2008 | Unda | |
| 2009/0266828 | A1 | 10/2009 | Cai et al. | |
| 2009/0266829 | A1 | 10/2009 | Bailey | |
| 2010/0096395 | A1 | 4/2010 | Miller | |
| 2010/0108701 | A1 | 5/2010 | Lee | |
| 2010/0200590 | A1 | 8/2010 | Shadrach, III et al. | |
| 2011/0089174 | A1 | 4/2011 | Smith et al. | |
| 2011/0139800 | A1 | 6/2011 | Urban | |
| 2011/0284564 | A1 | 11/2011 | Hsieh et al. | |
| 2012/0279879 | A1 | 11/2012 | Lee et al. | |
| 2012/0312827 | A1 | 12/2012 | Zuares et al. | |
| 2016/0198876 | A1 * | 7/2016 | Mithal | A47G 19/2211 220/713 |

FOREIGN PATENT DOCUMENTS

| | | | |
|---|---|---|---|
| EP | 1118549 | A1 | 7/2001 |
| EP | 1293438 | A2 | 3/2003 |
| EP | 1746042 | A1 | 1/2007 |
| GB | 2167049 | A | 5/1986 |
| GB | 2322289 | A | 8/1998 |
| GB | 2327035 | A | 1/1999 |
| GB | 2450909 | A | 1/2009 |
| WO | 2010126341 | A2 | 11/2010 |

* cited by examiner

CUP LID WITH RECLOSABLE CAP

RELATED APPLICATIONS

This application is a continuation of U.S. patent application Ser. No. 15/393,960, filed Dec. 29, 2016, which claims the priority benefit of U.S. provisional application No. 62/419,306, filed Nov. 8, 2016, titled "Cup Lid With Reclosable Cap," the contents of which are each hereby incorporated by reference in their entirety.

BACKGROUND

Cup lids can be used to seal the top opening of a beverage container. For example, vendors often provide disposable cup lids with cups or other containers that contain drinks such as coffee, tea, soda, etc. Such cup lids include an annular mounting portion that allows the lid to attach and/or seal with the cup. The lids have an opening or spout that allows users to drink or otherwise pour fluid from the cup or container while the lid is in place.

Some cup lids have an integrated closure member that facilitates closing or covering of the opening or spout. The closure members can help inhibit spillage or undesired leaking through the opening when the opening is not in use. For example, some lids have an arm with a tab at a distal end that extends from the periphery of the lid. A user may flex the arm to insert the tab into the drink opening of the lid, thereby closing or plugging the opening.

Some cup lids have printed text that displays promotional, warning, or other types of information. For example, some cup lids will include printed text that warns consumers about the temperature of the contents of the cup, or that provides branding information in the form of logos or product names associated with the beverage. Some cup lids will also include other information relating to the size of the cup, or whether or not the lid is recyclable. Users may find this printed text difficult to read for various reasons. For example, the printed text may be formed via a deformation in the lid itself, and thus have the same color as the surrounding portion of the lid. As a result, the text may not be readily discernable in certain light or at certain viewing angles. Further, the arm or sealing mechanisms may lie over the text, thereby obscuring, hiding, or otherwise making the text difficult to read.

SUMMARY

In one form according to the present invention, this application discloses and describes a lid assembly that includes a cover and a cap. The cover is configured to attach to a cup opening. The cover includes an annular mounting portion that secures and/or seals the cover to a top rim of the cup. The cover also has an annular upper ridge with a drink opening that allows fluid contents of the cup to be poured from the cup. An annular outer sidewall extends upward from the mounting portion to an outer peripheral edge of the annular upper ridge. The cover also has an annular inner sidewall circumscribing an interior portion. The annular inner sidewall has a surface that slopes downward and inward from the annular upper ridge to the interior portion. The cap is attachable to the cover and includes a main body and a flap that pivotally extends from the main body. The flap has a hinge and a plug at an end of the flap. The plug can be inserted into the drink opening to form a seal that inhibits fluid within the container from leaking out of the drink opening. In some aspects, the cover has printed text on the sloped surface of the annular inner sidewall. The printed text extends across a location of the annular inner sidewall that is opposite the drink opening. In additional and/or alternative aspects, the interior portion of the cover includes a first post and the main body of the cap includes a corresponding second post defining a cavity on the underside of the cap. The first post is configured to fit within the second post with a friction fit to help secure the cap to the cover. The second post is also configured to form a securable connection with a cavity defined on an underside of the plug. In this way, the flap can be pulled back to the second post and secured in place when it is not sealing the drink opening.

In another aspect, a lid assembly for covering an opening of a cup includes a cover configured to cover the opening of the cup and a cap configured to be selectably attached to the cover. The cover includes an annular mounting portion configured to secure the cover to a top rim of the cup, an annular sidewall that extends upwardly from the mounting portion to an outer periphery of an upper ridge of the cover, and a drink opening defined in the upper ridge. A tapered sidewall extends around an interior portion of the cover. The tapered sidewall includes one or more regions at which the tapered sidewall tapers gradually downward from an inner periphery of the ridge towards respective one or more inner vertical surfaces of the interior portion. An interior surface of the cover extends between respective lower edges of the vertical surfaces to cover substantially the area of the interior portion of the cover. The cap includes a main body configured to be positioned over and to cover the interior surface of the interior portion of the cover. The cap also includes a flap that is pivotally connected to the main body. The cap includes a plug at an end opposite a hinge or pivot end configured to be inserted within the drink opening and to seal the drink opening.

Other features and advantages will be, or will become, apparent to one with skill in the art upon examination of the following figures and detailed description. It is intended that all such additional features and advantages included within this description be within the scope of the invention as defined by the following claims.

BRIEF DESCRIPTION OF THE DRAWINGS

The components in the figures are not necessarily to scale, emphasis instead being placed upon illustrating the principles of the design. Moreover, in the figures, like-referenced numerals designate corresponding parts throughout the different views.

DETAILED DESCRIPTION

This application describes various examples of a lid assembly for a drinking cup. The lid assembly is arranged to form a securable attachment to the opening of the cup, such that the lid remains in place on the cup when the cup is tipped to dispense fluids. The lid assembly may form a tight seal that inhibits fluid from within the cup from leaking from any undesirable locations, namely, from any locations other than through the drink opening.

The lid assembly generally comprises a cover component and a cap component that are separably attachable to one another. The cover component generally covers the top of a cup, and includes a drink opening through which a user may drink or otherwise pour out the cup's contents. The cap component attaches to the cover component and allows the drink opening to be closed or sealed. More specifically, the cap component includes a flap and a plug that is pivotable between open and closed positions so that the drink opening can be closed and/or sealed to inhibit unwanted dripping, leaking, or spilling of the cup's contents through the drink opening, and to help improve the thermal insulation properties of the lid assembly. The cap may be an optional member. The cap may be configured to be secured to or released from the cover by a user, such as a consumer.

Figure 1:
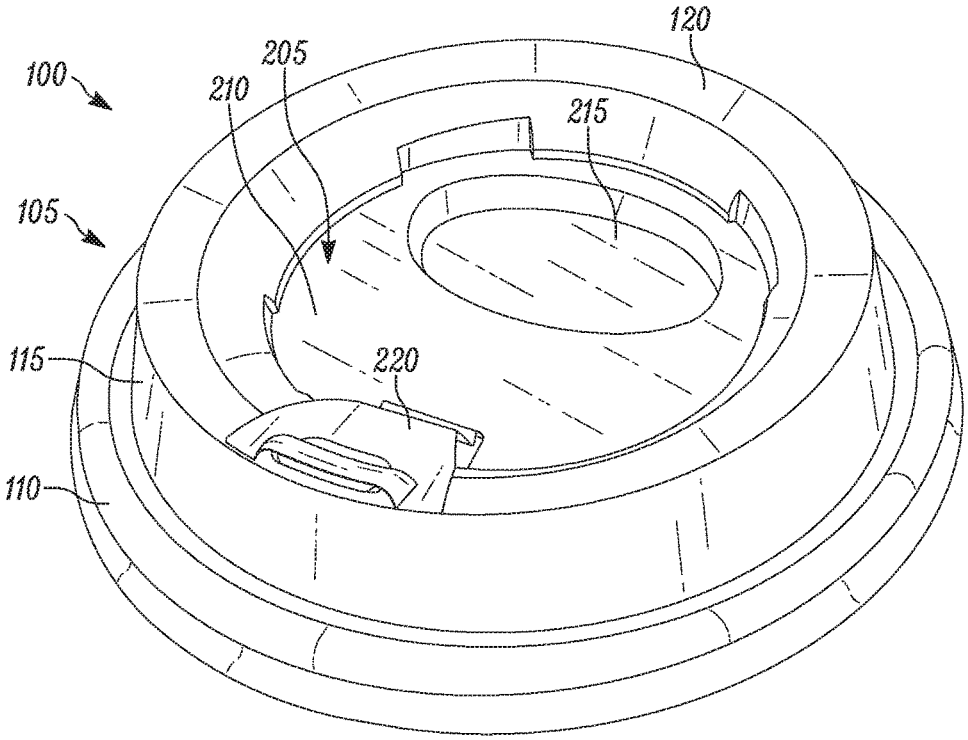
FIG. 1 is a perspective view of a lid assembly for covering a drink cup in a closed configuration in accordance with examples described in this application.

FIG. 1 illustrates a perspective view of one example of a lid assembly 100 for covering a drink cup. The lid assembly 100 includes a cover 105 that is configured to attach to the cup and may be used to substantially seal the contents therein within the cup. The lid assembly 100 also includes a cap 205 that may be separately attached to the cover 105.

The cover 105 includes an annular mounting portion 110 configured to secure the cover 105 to a top rim of the cup. In some forms, the annular mounting 110 portion 110 forms a seal that inhibits fluid from within the cup from spilling or otherwise leaking from the cup around the top rim. An annular sidewall 115 extends upwardly from the mounting portion 110 to an outer periphery of an upper ridge 120 of the cover 105. A drink opening 122 is defined in the upper ridge 120 as shown in FIG. 2.

Figure 2:
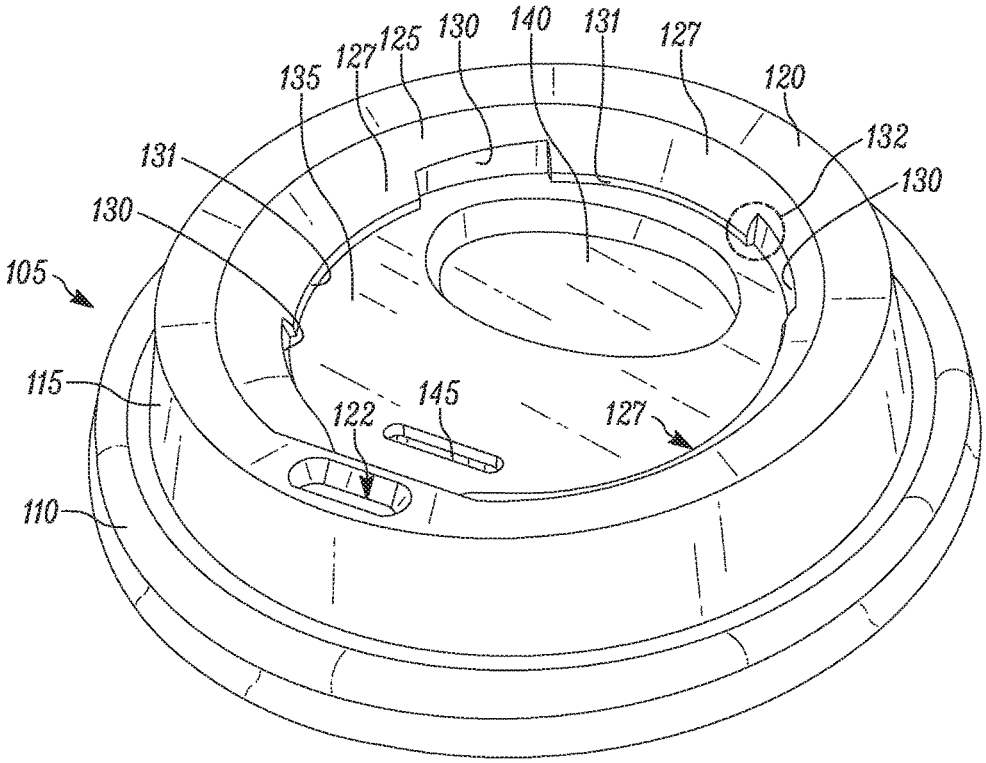
FIG. 2 is a perspective view of a cover of the lid assembly of FIG. 1.

As illustrated in FIG. 2, a tapered sidewall 125 extends around the interior portion of the cover 105. The sidewall 125 includes a first set of regions where the sidewall 125 tapers gradually downward from the inner periphery of the ridge 120 towards a first set of vertical surfaces 130. That is, each region tapers towards a different vertical surface 130. In some implementations, the sidewall 125 also includes a set of ledge regions 127 where the sidewall continues to taper past the first set of vertical surfaces 130 to a second set of vertical surfaces 131.

An interior surface 135 of the interior portion extends between lower edges of the first set of vertical surfaces 130 to thereby substantially cover the entire area of the interior portion. In implementations that include the ledge regions 127, lower edges of the second set of vertical surfaces 131 may be separated from the interior surface 135 by a distance to thereby define a gap or undercut 132 between lower surfaces of the ledge regions 127 and the interior surface 135. The gap 132 width may be slightly larger than the thickness of the cap 205 to facilitate insertion of edge portions of the cap 205 into the gaps 132 below the ledge regions 127. For example, the gap width may be about 0.100".

Figure 3:
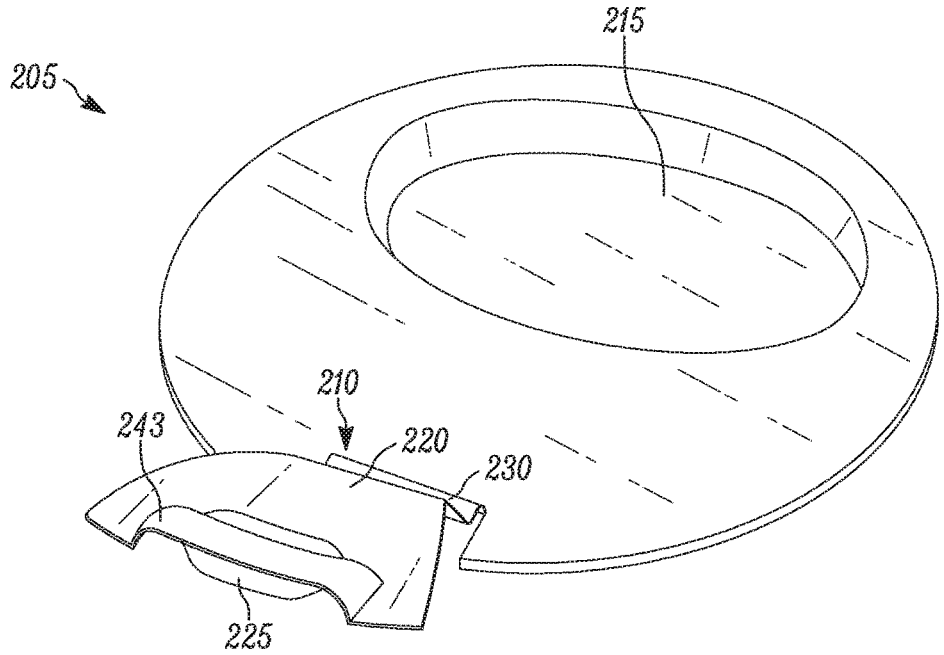
FIG. 3 is a perspective view of a cap of the lid assembly of FIG. 1.

Referring to FIG. 3, the cap includes a main body 210, and a flap 220 that is pivotally connected to the main body 210. The main body 210 is configured to be positioned over and to substantially cover the interior surface 135 of the interior portion of the cover 105. While a solid surface is illustrated, it is understood that the main body 210 does not generally play a role in sealing the contents within the cup. Therefore, one or more openings for decorative purposes, to reduce material usage, etc., may be provided in the main body 210.

In some implementations, the main body 210 of the cap 205 may define a protruded surface 215. In this regard, the interior surface 135 of the cover 105 may define a complementary indented surface 140 configured to receive the protruded surface 215. The protruded surface 215 and the indented surface 140 cooperate to control alignment of the cap 205 within the interior portion of the cover 105.

The flap 220 is pivotally connected to the main body 210. In some implementations, the flap 220 is connected via a resilient portion or hinge 230. The resilient portion 230 may have a generally curved cross-section and may be sized to facilitate opening and closing of the flap 220 for a repeated number of times without breaking. In this regard, the resilient portion 230 may be configured to extend somewhat below a plane within which the main body 210 lies. The distance by which the resilient portion 230 is below the main body 210 may be related to the radius of the curved section. To facilitate flush mounting of the main body 210 within the interior portion of the cover 105, the interior surface 135 of the cover 105 may define an indentation 145 with a depth that at least matches the distance by which the resilient portion 230 extends below the main body 210 to prevent substantial interference between the interior surface 135 of the cover 105 and the resilient portion 230 of the flap 220.

At the opposite end of the flap 220 from the pivot end, the flap 220 includes a plug 225 configured to be inserted within the drink opening 122 and to seal the drink opening 122 when the flap 220 is placed in the closed configuration, as illustrated in FIG. 1. The flap 220 may also include a handle or tab portion 230 arranged above the plug 225. The handle 230 may be pinched between a user's thumb and forefinger to facilitate removal of the plug 225 from the drink opening 122.

Figure 4:
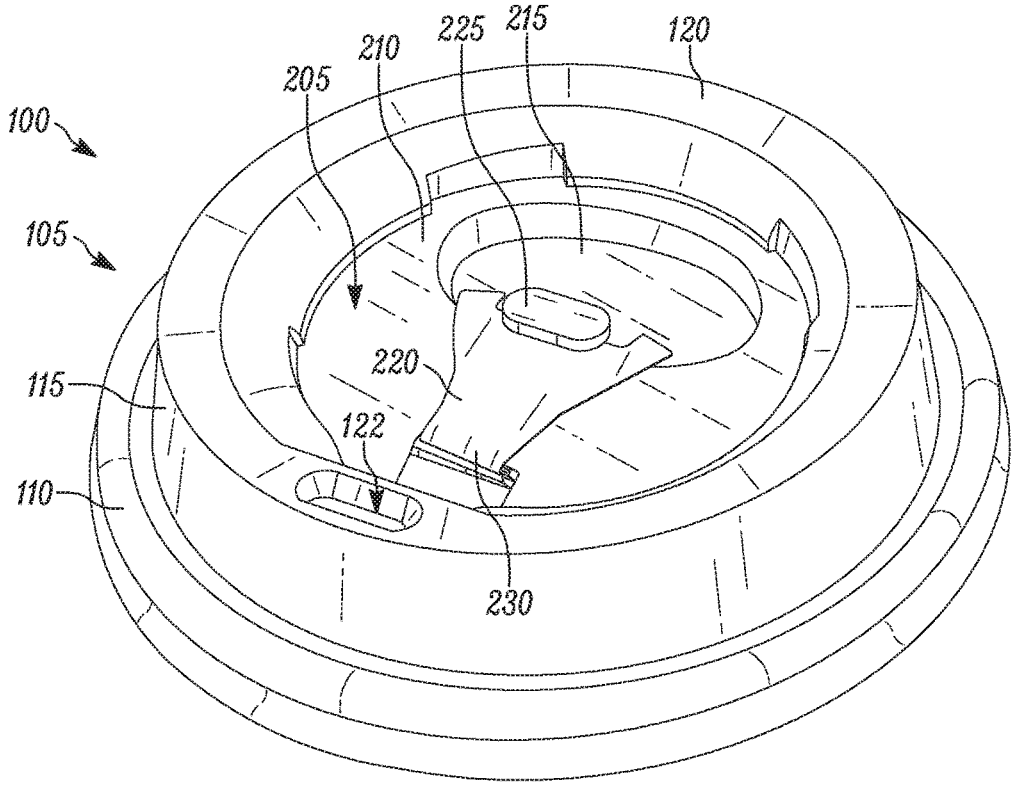
FIG. 4 is a perspective view of the lid assembly of FIG. 1 in an open configuration.

In one implementation, the gripping portion or handle 243 is also arranged relative to the protrusion 215 in the main body 210, such that when the flap 220 is placed in the fully open position (see FIG. 4), the handle 230 enters the cavity defined by the protrusion 215 and engages an inside edge of the protrusion 215 to thereby retain the flap 220 in the open configuration. Other methods known in the art may be utilized to secure the flap 220 in the open configuration.

The cover 105 and cap 205 may come pre-assembled or may be provided separately. When provided separately, a user may insert the cap 205 into the interior of the cover 105. In implementations without the ledge regions 127, the disk may be sized to provide a friction fit against the inner vertical surfaces 130 at which the first set of regions of the tapered sidewall 125 terminate to thereby secure the cap 205 within the interior portion of the cover 105.

In implementations that include the ledge regions 127, the diameter of the main body may be sized so that the edges of the main body 210 of the cap 205 resiliently snap into the gap 132 between the lower surfaces of the ledge regions 127 and the interior surface 210 of the cover 105 when the cap 205 is attached to the cover. The angle at which the tapered sidewall 125 tapers may be adjusted to allow the disk portion 210 to slide more easily into the fully sealed position.

Figure 5:
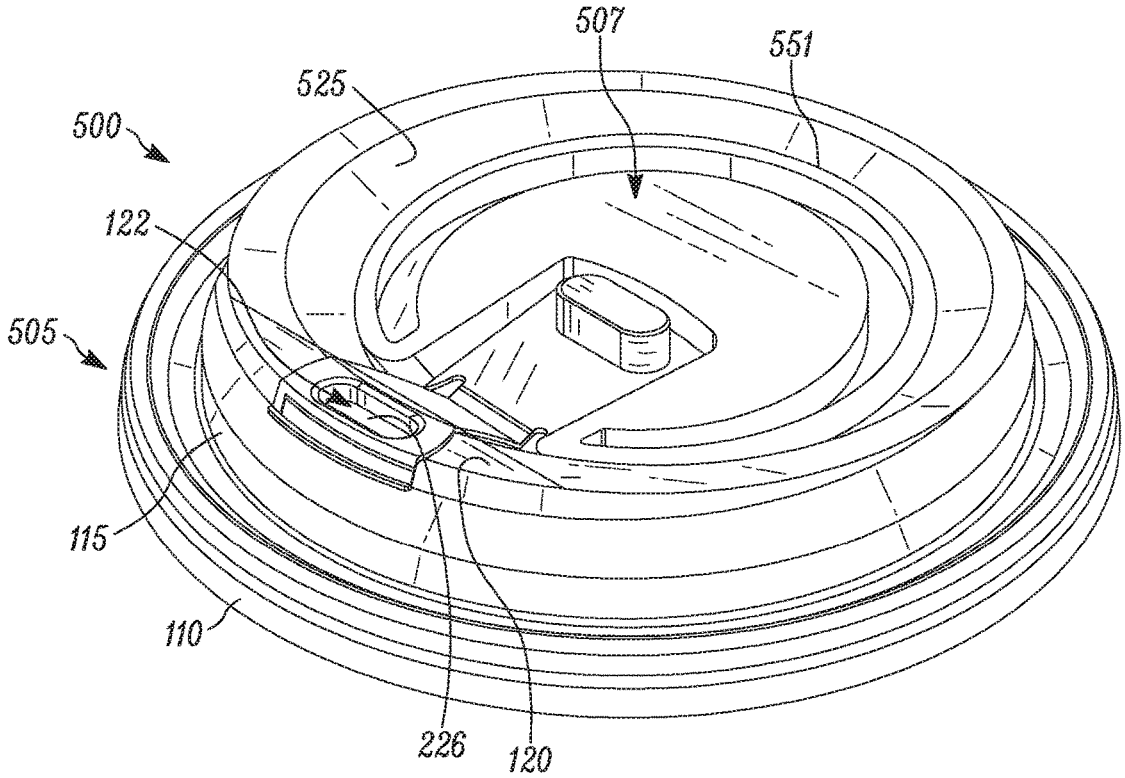
FIG. 5 is a perspective view of another lid assembly in accordance with other examples described herein.

FIG. 5 illustrates a perspective view of a second lid assembly 500 embodiment for covering an opening of a drink cup. The lid assembly 500 includes a cover 505 that is configured to attach to the top rim of the cup and to substantially seal the contents therein within the cup. The lid assembly 500 also includes a cap 507 that may be separably attached to the cover 505. The lid assembly 500 and related components are similar in structure to the lid assembly 800 and related component shown in FIGS. 8-16, however, the lid assembly 500 does not include printed text, such as a warning label, trademark, or logo. It should be appreciated that the various features and structural components of the lid assembly 500 and the lid assembly 800, including the printed text, are interchangeable with one another. For instance, the embodiments of the lid assembly 500 shown and described with respect to FIGS. 5-7 could be modified to include printed text, as with the embodiments shown and described in FIGS. 8-15.

Figure 6A:
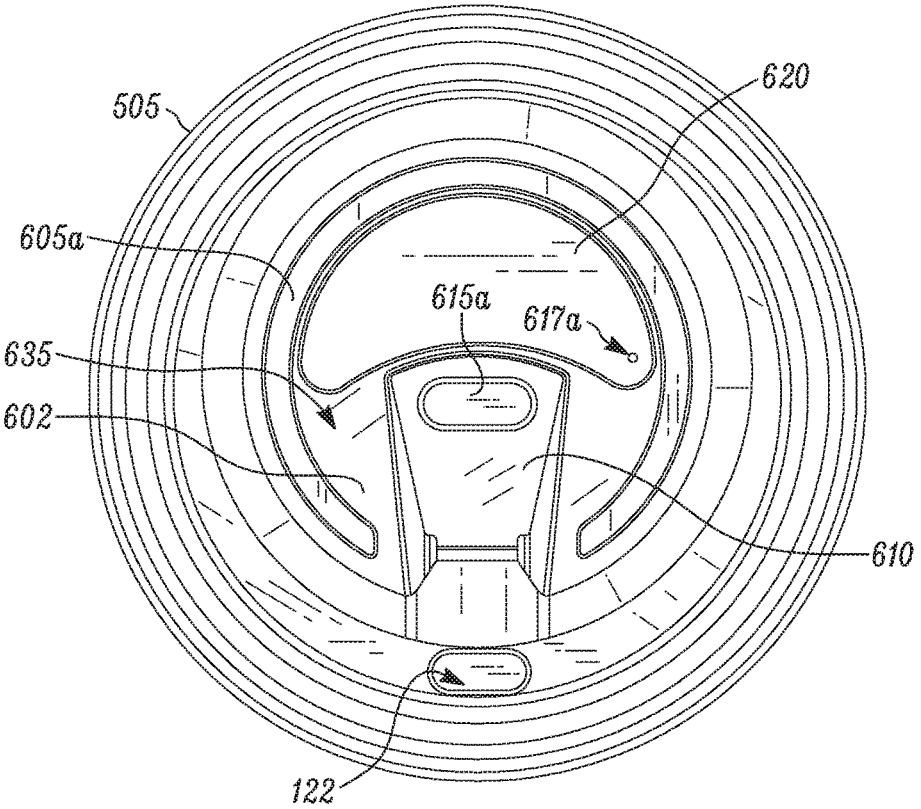
FIGS. 6A and 6B, respectively, are top views of a cover and a cap of the lid assembly of FIG. 5.
Figure 6B:
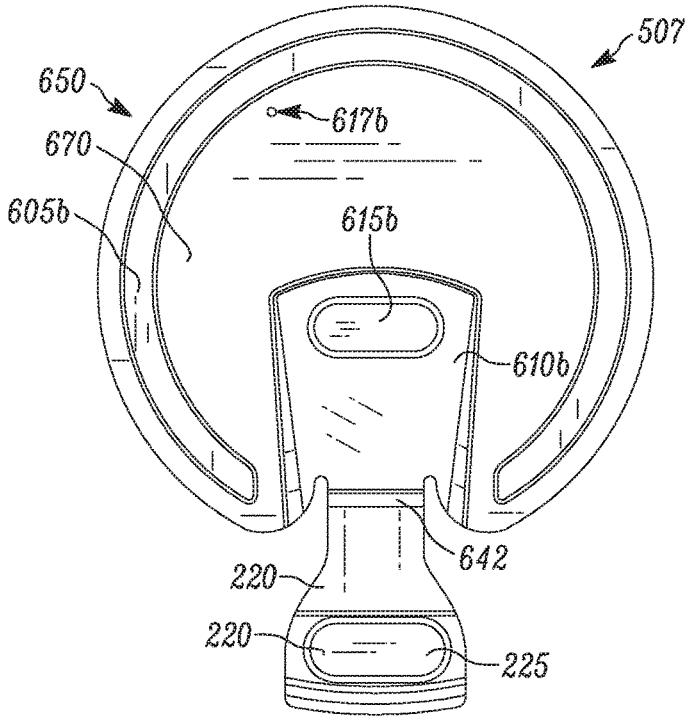

Referring to FIGS. 6A and 6B, the lid assembly generally includes many of the features described above with reference to the first lid assembly 100 embodiment. For example, the cover 505 of the lid assembly 500 includes an annular mounting portion 110, an annular sidewall 115 that extends upwardly from the mounting portion 110 to an outer periphery of an upper ridge 120 of the cover 105, and a drink opening 122 that is defined in the upper ridge 120. A tapered sidewall 525 (shown in FIG. 5) extends between the upper ridge 120 and an interior portion 635.

The cap 507 includes a main body 650 that fits over the interior portion 635 of the cover 505. A flap 220 is pivotally connected to the main body 650 via a hinge 642. A plug 225 is arranged at an end of the flap 220 and is sized and configured to be received within the drink opening 122 of the cover 505 with a friction fit.

The interior portion 635 of the cover 505 extends within the area defined by the interior edges 551 of the tapered sidewalls 525. The interior portion 635 includes an upper surface 602, a groove 605*a*, a recessed well 610*a*, and a recessed surface 629. The cap 507 is configured to fit snuggly over the interior portion 635 of the cover and has many of the same features so that the cap 507 nests over the interior portion 635. For example, the cap 507 includes an upper surface 670 that generally covers the interior portion 635 of the cover 507, a groove 605*b* which forms a protrusion extending from a bottom side of the cap 507 configured to nest within the groove 605*a* in the cover 505, and a well 610*b* configured to nest within the well 610*a* of the cover 505.

The grooves 605*ab* (i.e. 605*a* and 605*b*) generally extend around the periphery of the interior portion 635 of the cover 505 and the cap 507, respectively, and terminate at or adjacent opposite sidewalls of the respective wells 610*ab*. The groove 605*a* in the cover 505 has a depth of about ⅛", relative to the upper surface 602, and an interior shape configured to complement the corresponding outside shape of the groove 605*b* of the cap 507. The depth of the grooves is merely exemplary and may be adjusted as necessary. More specifically, when viewed from below, the groove 605*a* corresponds to a protrusion 606 (see the cross section of FIG. 7) or ridge that extends below the cap 507. The interior sidewalls of the groove 605*a* of the cover 505 may have a negative draft angle of about 3 to 7 degrees that match corresponding positive draft angles of the protrusion 606. Other draft angles may be suitable. While the illustrated grooves 605*ab* extend around most of the respective peripheries, it is understood that the grooves 605*ab* may extend to a lesser amount or that the grooves 605*ab* may not extend by the same amount. For example, the groove 605*a* in the cover 505 may extend around the periphery as illustrated, while the groove 605*b* in the cap 507 may extend around the cap 507 to a lesser degree, or be formed of segmented sections that fit within the groove 605*a* of the cover 505. Other configurations are contemplated.

The respective wells 610*ab* have a width and depth sized to receive the flap 220 of the cover 507. A protrusion or post 615*b* having a racetrack shape extends upwardly from the bottom surface of the well 610*b* defined in the cap 507. The protrusion 615*b* is configured to fit within a recess 226 formed in the backside of the plug 225 disposed at the end of the flap 220 to secure the flap 220 in an open position. In some implementations, the arrangement may be reversed such that the cover 505 may define a corresponding recess configured to receive a protrusion extending from the bottom side of the cap 507.

A small opening 617*a* is defined in the interior portion 635 of the cover 505 to facilitate equalization of pressure within the drink cup when the lid assembly 500 is attached to the cup. A corresponding opening 617*b* may be provided in the cap 507. The respective openings 617*ab* may be aligned to provide an unobstructed passage between the space within the cup and the atmosphere outside of the cup.

In some implementations, a recessed surface 620 may be defined in the interior portion 635 of the cover 505. The opening 617*a* may be defined within the recessed surface 620. The recessed surface 620 may be recessed below the upper surface 602 of the interior portion of the cover 505 by a depth of about 1/16" of a different depth.

Figure 7:
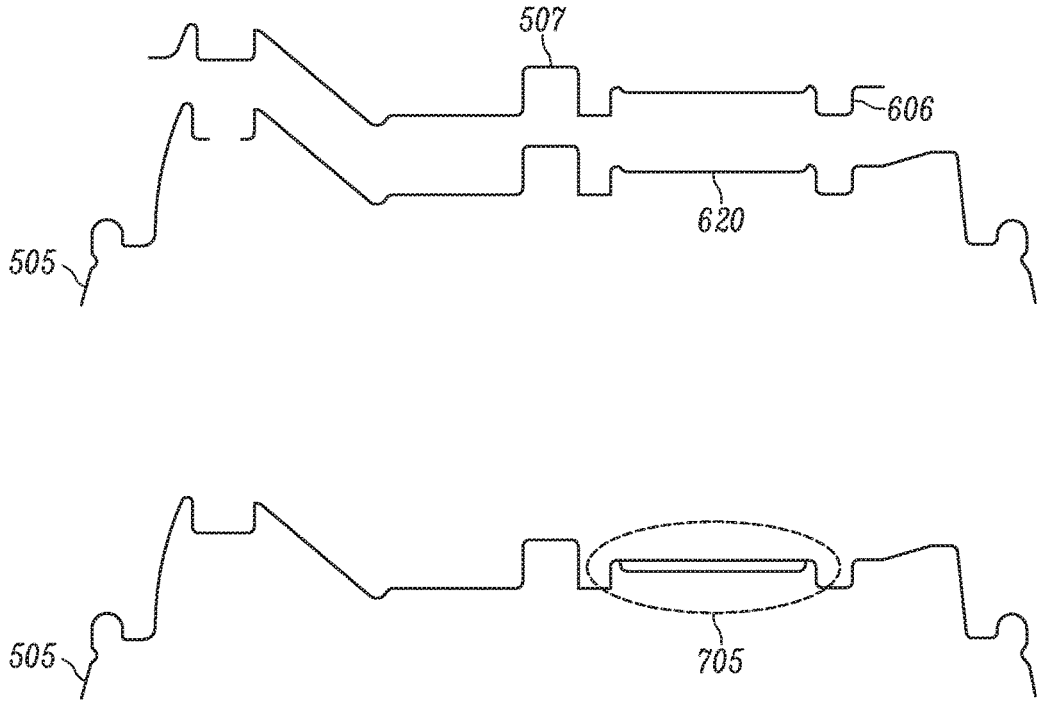
FIG. 7 is a cross-sectional view of the lid assembly of FIG. 5 in both a disassembled and assembled state.

As illustrated in FIG. 7, this results in the formation of a cavity 705 between cap 507 and the cover 505 when the two are assembled. The cavity 705 facilitates relaxation of the alignment requirements between the respective openings 617*ab* by providing a conduit between the openings 617*ab*. Moreover, the openings 617*ab* may be spaced laterally apart from one another to minimize fluid leakage through the openings 617*ab* that may otherwise occur when the two openings 617*ab* are aligned.

While the lid 100 has been described with reference to certain embodiments, it will be understood by those skilled in the art that various changes may be made and equivalents may be substituted without departing from the scope. For example, in the first lid assembly embodiment, in implementations that do not include the ledge regions 127, the set of regions that terminate at the first set of vertical sidewalls 130 may form one continuous region and the first set of vertical sidewalls 130 may be one continuous sidewall that generally extends around the interior portion of the cover. In implementations that include the ledge regions 127, the main body may not be sized to provide a friction fit against the first set of vertical surfaces 130. That is, the main body 210 may be held in place via the gap/undercut 132 below the ledge portions 127 alone. Of course, in the alternative, the main body 210 may also be sized to provide a friction fit against the first set of vertical surfaces 130.

The resilient portion of the flap 220 may be arranged above the main body 210 which may facilitate elimination of the indentation 145 in the interior surface 135 of the cover 105.

The lid may be made from a variety of materials including polystyrene, polypropylene, paper, and may include fillers such as talc or calcium. Paper materials may include paper from tree, sugarcane bagasse, fiber, etc. Other materials known to those skilled in the art, such as biodegradable and/or compostable materials, may also be utilized. In some implementations, the cover 105 and cap 205 may be made from different materials and have the same or different thickness. For example, the cap and cover may have a thickness of about 0.015". Alternatively, one of the cap and cover may have a thickness of about 0.012", and the other may have a thickness of about 0.015". The cover 105 and cap 205 may be manufactured via thermoforming, injection molded, pulp molded, etc.

Other alignment features (i.e., protrusions in the cap and indentations in the cover, or vise-versa) may be provided. Alternatively, the shape of the main body and the sidewall at which the tapered sidewall of the cover terminates may be keyed to align the main body within the interior portion of the cover.

In some implementations, the cap may be secured to the cover via an adhesive, friction welding, etc. In this regard, the main body 210 may have a diameter smaller than that of the tapered sidewall 125 at an inner edge thereof.

In yet other implementations, the main body 210 may include a retention protrusion configured to maintain the flap in the open configuration.

Some examples of lid assemblies described herein can be used to improve the manner that readable indicia, or printed text, is displayed on the lid assembly. That is, some of the lids are configured and arranged so that the printed text is easier for a user to identify, recognize, and read. Throughout this application, the terms "readable indicia" or "printed text" refers to text provided on the lid or its components in a recognizable format. The "printed text" or "readable indicia" can be printed with ink or paint, or it can be formed as a deformation in the lid material, for example, by being stamped, etched, engraved, embossed, or molded into the material that forms the lid or its components. The printed text or readable indicia may include letters, numbers and punctuation, but it can also include other graphics such as logos, symbols, shapes, designs, patterns, images, bar codes, Braille patterns, and the like. The terms "printed text" and "readable indicia" as used throughout this application are meant to be interchangeable with one another.

The printed text can be arranged in a manner so that a user drinking from the cup can readily recognize and read the printed text on the lid assembly. For example, the printed text is arranged on a sloped surface that is angled toward a location that generally corresponds with an eye level of a user holding or drinking from the cup. Providing the printed text on a sloped surface can help improve the visibility of the printed text by providing a more direct line of sight with a cup-holder's eyes, and by mitigating reflections of light off the surface of the lid. In some aspects, the printed text is provided as a deformation in the lid material, meaning that the text itself is merely a contoured texture and does not necessarily stand out by way of contrasting colors or shading. In these aspects, reflections, viewing angles, and other factors can diminish a user's ability to read or recognize the printed text. By providing the printed text on a sloped or angled surface, the printed text may be closer to perpendicular with a cup user's line of sight. Not only can this help make the printed text easier to read, it can also make the printed text stand out more and draw the attention of a cup user.

Further, providing the printed text on a sloped surface can also help improve the clarity of the printed text itself. For instance, where printed text is formed by a stamping or molding process, producing the printed text on a sloped surface can mitigate, inhibit, or reduce undesirable ghosting effects or other issues that can result from the molding or stamping processes, which can make the printed text blurrier or otherwise more difficult to read.

Some implementations provide the printed text in a manner so that the printed text is not covered or obstructed by other objects, such as a flap or a sealing mechanism. This can be accomplished by arranging a flap or sealing mechanism so that it leaves a portion of the lid assembly uncovered, or unobstructed in both an open or closed position. For example, a lid may provide for unobstructed text by arranging a securing post in or near the center of the lid assembly, so that the flap secures to the centralized post without covering or resting over at least a portion of the lid assembly on an opposite side of the post. The text on the lid assembly opposite the flap will therefore remain uncovered and readable at all times, regardless of whether the flap is in an open or closed position.

In some examples of the described lid assemblies, the shape of the cover and cap components are configured to provide a more aesthetic appearance. For example, some examples configure the shape of the cap, or the shape of the outer periphery of the cap so that it corresponds with the shape of certain components or portions of the cover. In particular, the shape of the outer perimeter of the cap may be designed to correspond with the outer periphery of an interior portion of the cover, so that the peripheral edge of the cap generally aligns with the outer periphery of the interior portion when installed on the lid assembly. Matching these shapes can align two edges so that they appear as a single edge to a cup user, and give the impression that the lid assembly is a single piece, rather than two separate pieces. This single edge look may appear less busy, sleeker, and otherwise more visually appealing to consumers. Matching the shape of the cap and interior portion of the cover also provides a relatively large area on the cap in which printed text may be provided, such as a trademark, logo, or other information, as described in more detail below.

Some features described herein also allow for an improved connection between the separate cap and cover components of the lid assembly. For instance, some examples utilize a centralized post in the cover, and a corresponding cavity in the cap that is designed to form a tight, friction fit with the centralized post. This post can improve the securement of the cap to the cover, and inhibit unwanted lifting or separation that can result from repeated lifting and movement of the flap between the open and closed positions. In some aspects, the arrangement of the centralized post allows for more freedom in the arrangement between the grooves of the cover and cap, such that the cap can take on different shapes or attach to the cover in different ways while still maintaining a firm fit onto the cover 505. Further, in some aspects, the arrangement of the centralized post can replace the groove configuration altogether, such that the post is the only friction connection holding the cap to the cover.

Figure 8:
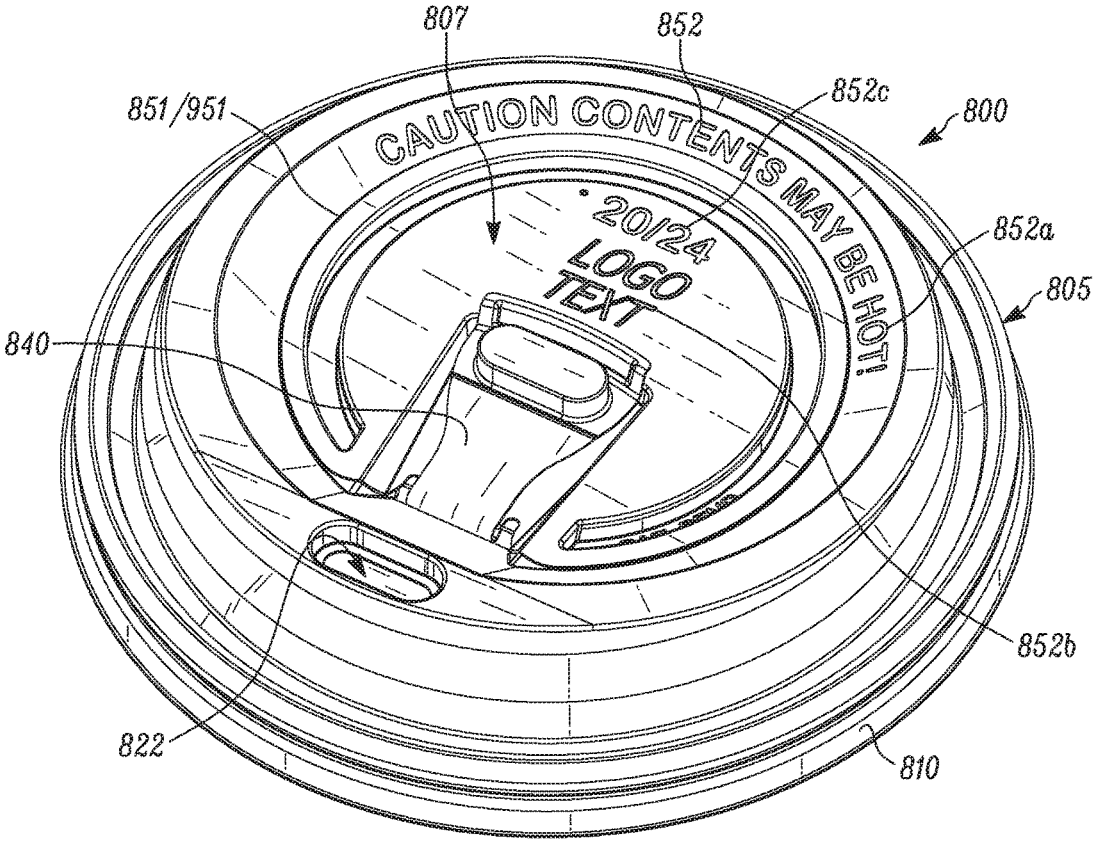
FIG. 8 is a perspective view of a lid assembly with printed text and a flap in an open configuration in accordance with examples described herein.
Figure 9:
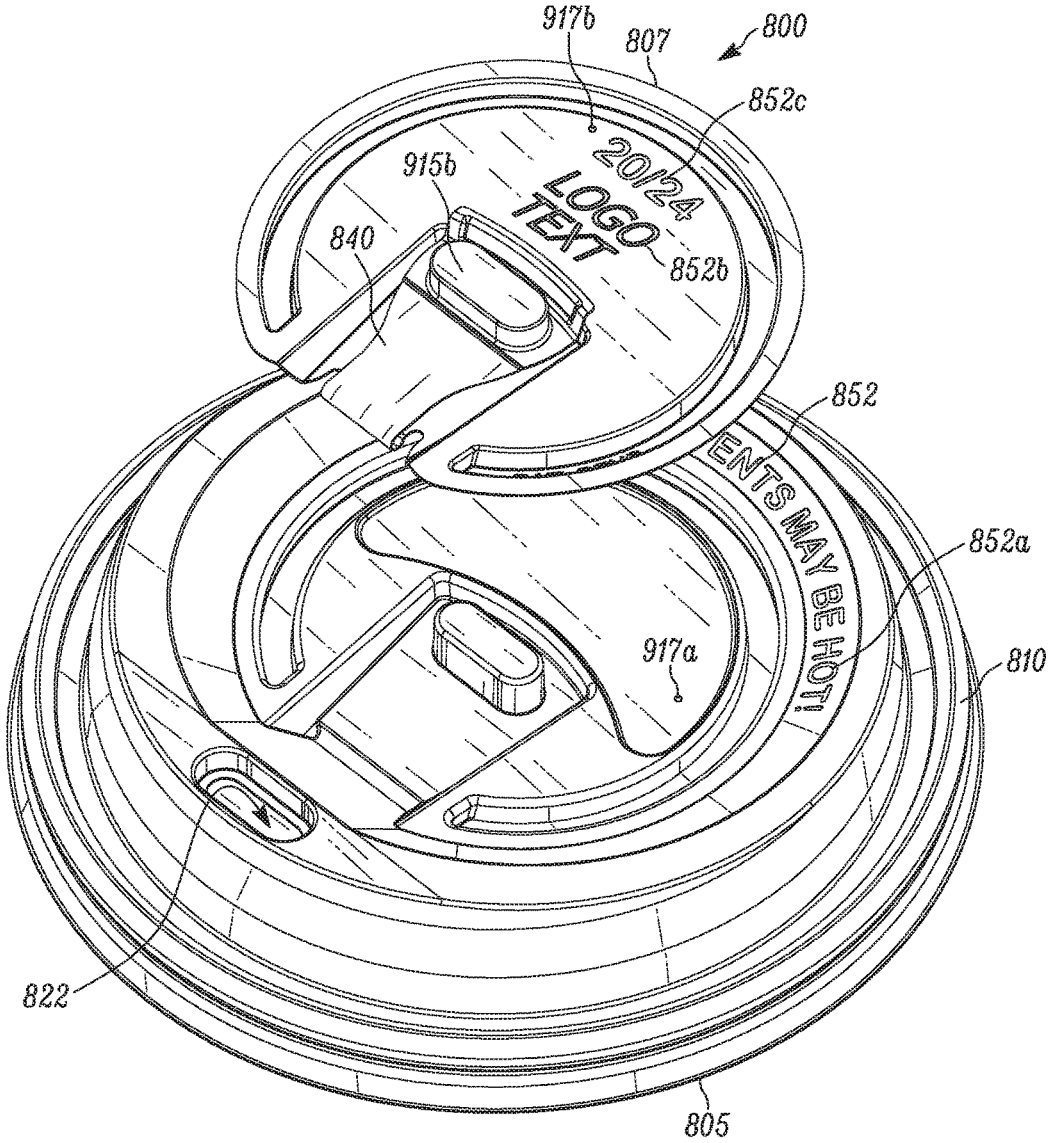
FIG. 9 is an exploded perspective view of the lid assembly of FIG. 8.
Figure 10:
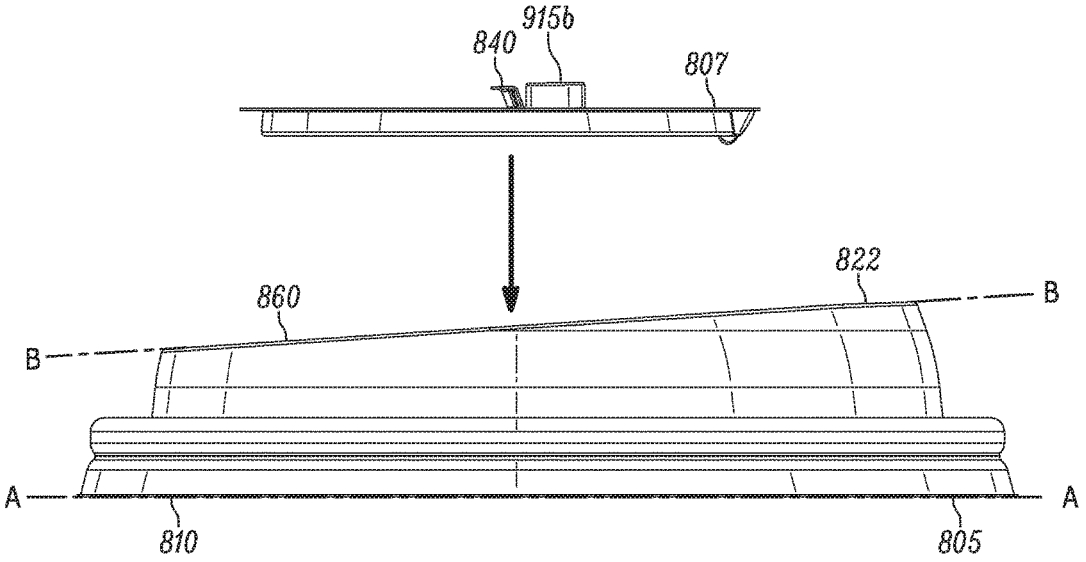
FIG. 10 is an exploded side view of the lid assembly of FIG. 8.
Figure 11:
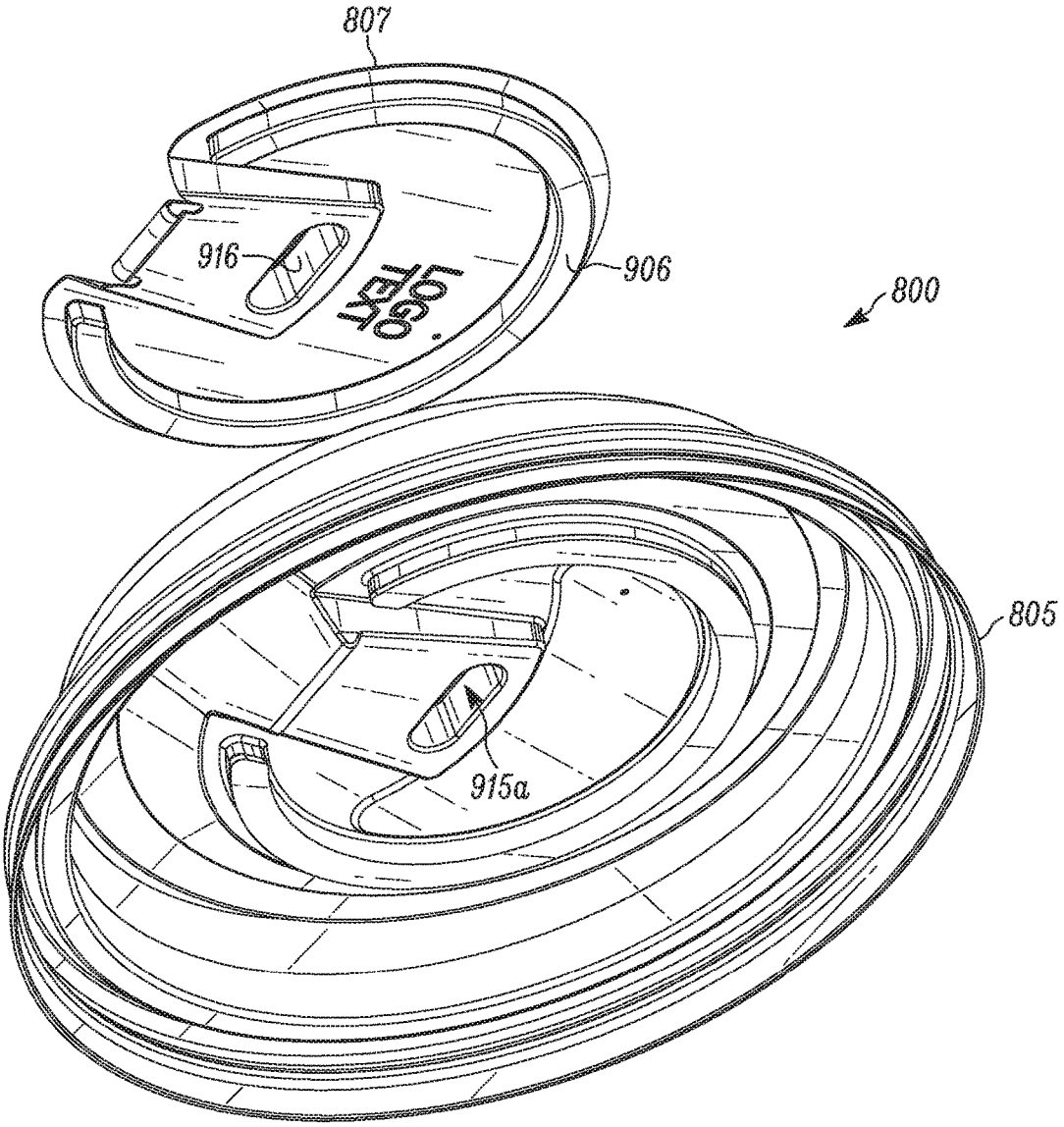
FIG. 11 is an exploded bottom perspective view of the lid assembly of FIG. 8.
Figure 12:
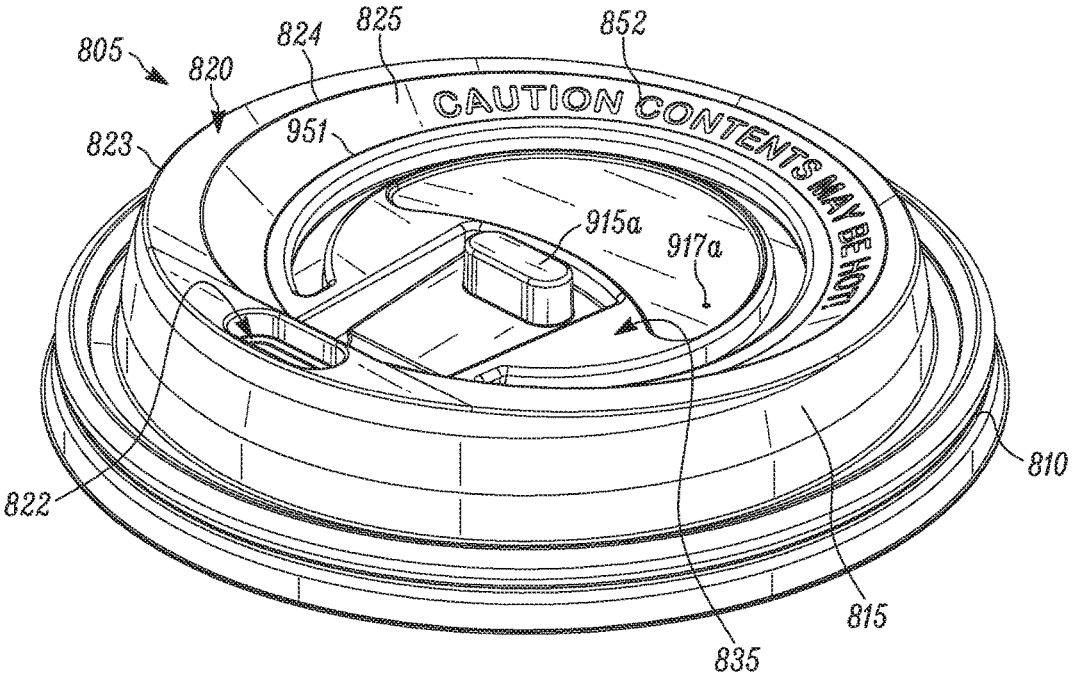
FIG. 12 is a perspective view of a cover component of the lid assembly of FIG. 8.
Figure 13:
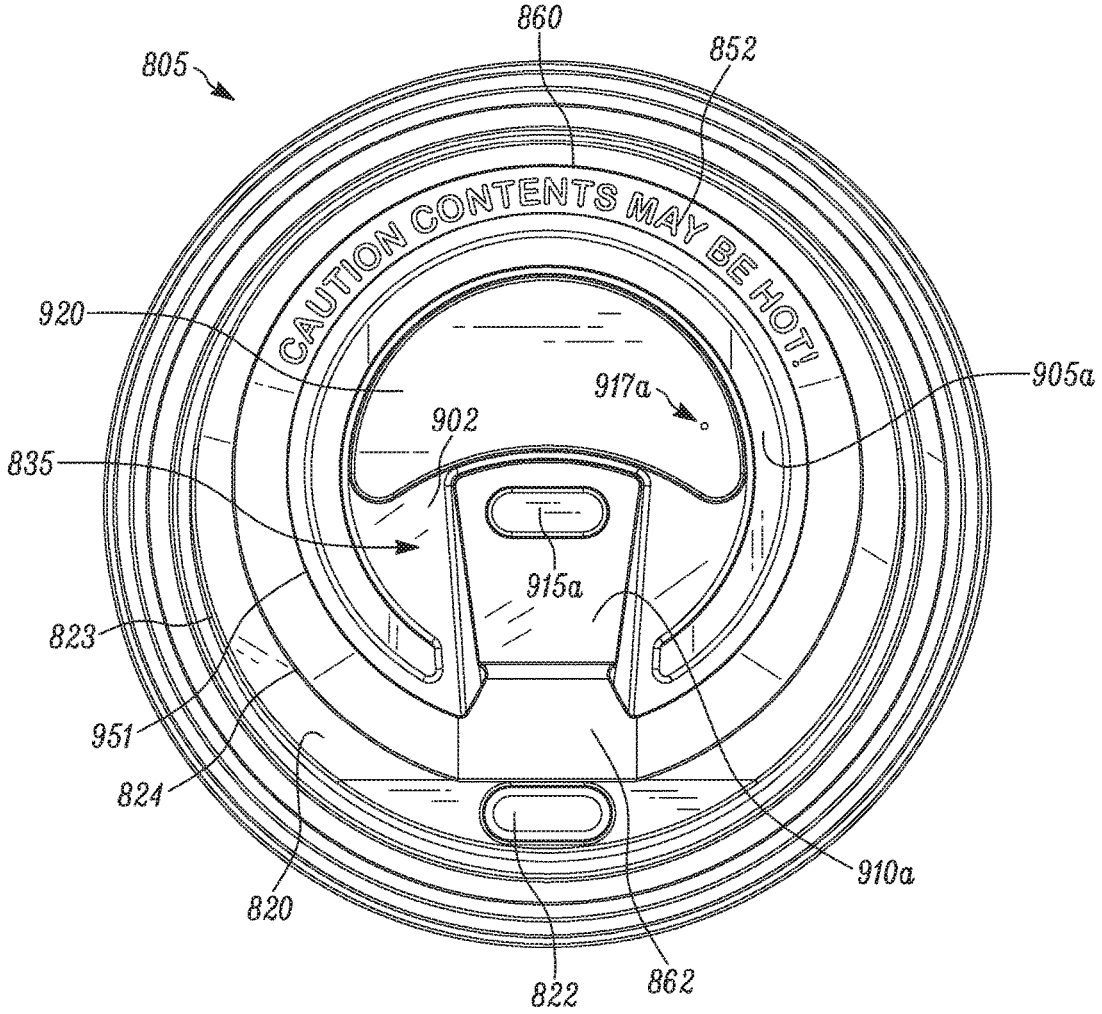
FIG. 13 is a top view of the cover component of FIG. 12.
Figure 14:
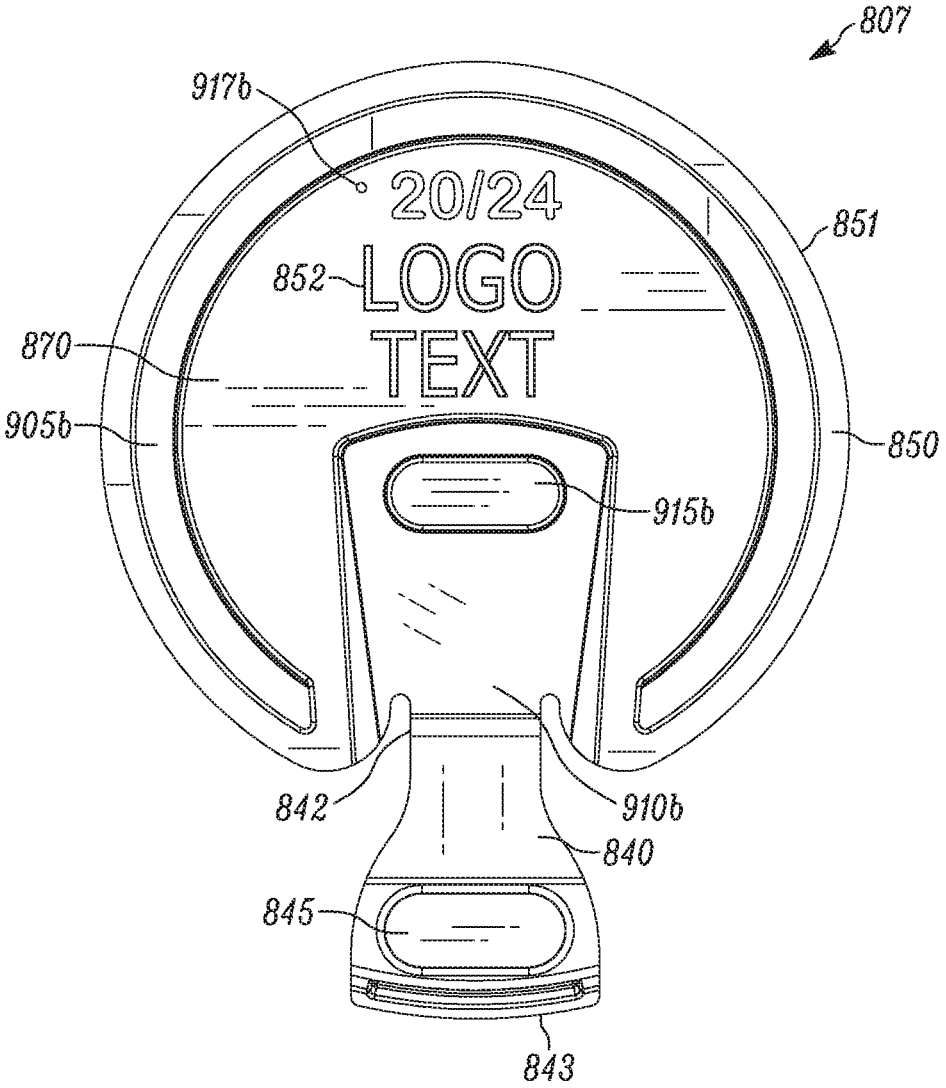
FIG. 14 is a top view of a cap component of the lid assembly of FIG. 8.
Figure 15:
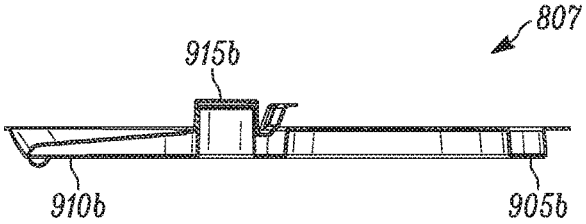
FIG. 15 is a cross-sectional view of the cap component of FIG. 14.
Figure 16:
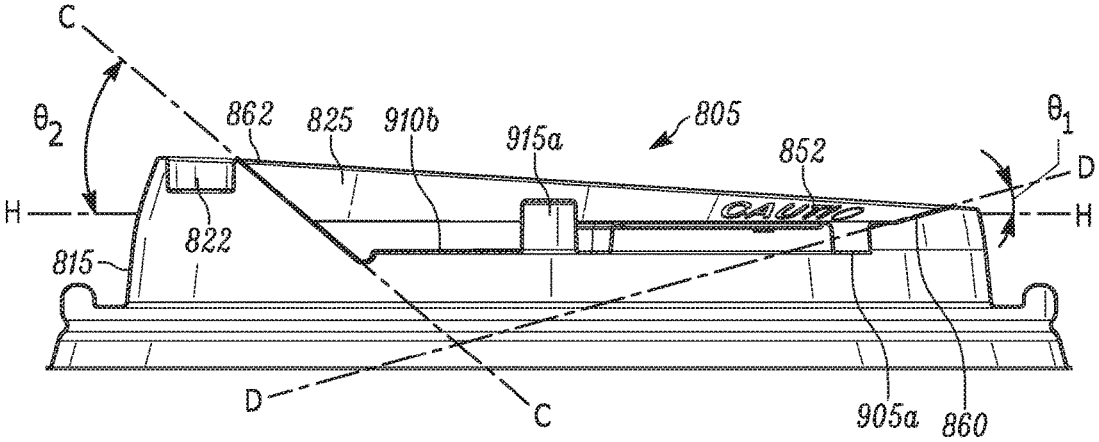
FIG. 16 is a cross-sectional view of the cover component of FIGS. 12 and 13.

The embodiments shown in FIGS. 8-16 present examples of a lid assembly that utilizes many of the features described above. FIG. 8 illustrates a perspective view of an example of a lid assembly 800 comprising a cover 805 and a cap 807 with printed text on the cover 805 and the cap 807. The lid assembly 800 in FIG. 8 is shown in an assembled state, namely, with the cap 807 secured to the cover 805. FIGS. 9, 10, and 11 show exploded top perspective, side, and bottom perspective views, respectively, of the lid assembly 800, that is, with the cap 807 removed from the cover 805. The cap 807 in FIGS. 8-11 is shown with a flap 840 that is in an open position, namely, the flap 840 is away from, and not closing off the drink opening 822. As shown in FIGS. 8-11, the flap 840 is held in the open position by securing the plug 845 (shown in FIG. 14) to the post 915*b*. FIGS. 12 and 13 show a perspective and top view, respectively, of the cover 805 component by itself, removed from the cap 807. FIG. 14 shows a top view of the cap 807 by itself, removed from the cover 805. The cap 807 of FIG. 14 is shown in a closed state, that is, with the flap 840 extending away from the main body 850 of the cap 805, such that the plug 845 on the end of the flap 840 could be inserted into and seal the drink opening 822. FIGS. 15 and 16 show side, cross-sectional views of the cap 807 in an open configuration, and the cover 805, respectively.

The lid assembly 800 of FIGS. 8-16 may be similar or even the same as the lid assembly 500 shown and described with respect to FIGS. 5-7, with the exception that lid assembly 800 includes printed text 852 formed into the cover 805 and cap 807 components. The printed text 852 is shown as a deformation in the material that forms the cover 805 or cap 807. That is, the printed text 852 is imprinted into the material by way of an indentation or engraving. This can be formed via a variety of different techniques, including, for example, by molding, stamping, thermosetting, or other techniques. The printed text 852 includes warning text 852*a* that informs users of potential hazards associated with the cup or the contents therein. The printed text 852 also includes branding information 852*b* that identifies or promotes products or brands, such as that of the lid manufacturer, the cup manufacturer, or the provider of the contents within the cup (e.g., a particular restaurant or coffee shop). The branding information 852*b* can include trade names or other non-alphanumeric graphics such as logos, symbols, or other images. The printed text 852 also includes informative text 852*c* that provides useful information relating to the lid, cup, or contents. For instance, the informative text 852*c* can be used to identify the size or volume of the cup, instructions on how to assemble or manipulate the lid or components, information about the contents served in the cup, the material that the cup or lid is formed from, whether the cup and/or the lid is recyclable, production or batch information associated with the lid or the cup, or patent or other intellectual property markings, to name but a few examples.

Referring to FIGS. 12 and 13, the lid assembly 800 generally includes many of the features described above with reference to lid assembly 100 and lid assembly 500. For example, the cover 805 of the lid assembly 800 includes an annular mounting portion 810, an annular outer sidewall 815 that extends upwardly from the mounting portion 810 to an outer peripheral edge 823 of the annular upper ridge 820 of the cover 805, and a drink opening 822 that is defined in the upper ridge 820. An annular inner sidewall 825 extends between the inner peripheral edge 824 of the upper ridge 820 and the interior portion 835, and intersects the interior portion 835 at an outer periphery 951, which at least partially defines the shape of the interior portion 835. The annular inner sidewall 825 is sloped downward and inward between the annular upper ridge 820 and the interior portion 835.

The annular inner sidewall 825 includes printed text 852 along the sloped surface on a side 860 of the lid opposite the drink opening 822. Providing the printed text 852 in this location and on a sloped surface allows the printed text to be displayed in a manner that is recognizable and readable to a user as a user holds and/or drinks from the cup. The angle of the sloped surface can vary depending on a variety of factors including, but not limited to, the size of the cup and/or lid, the size of the printed text, and the radius of curvature of the annular inner sidewall 825.

The slope, or angle of the annular inner sidewall 825 can vary among locations about the periphery of the cover 805. For instance, the slope angle of the portion of the annular inner sidewall comprising printed text 860 may differ from the slope angle of the annular inner sidewall adjacent the drink opening 862, which can be seen from the cross-sectional view of the cover 805 of FIG. 16. The slope angle $\theta$ at a particular point is defined by the angle formed between an axis tangent to the annular inner sidewall at the particular point and the horizontal axis of the cover, which corresponds to the horizontal cup opening. The slope angle $\theta_1$ is measured as the angle between a line D-D, which is tangent with the slope of the annular inner sidewall 825 at the location 860 opposite the drink opening 822 (i.e., the location comprising the printed text 852), and a line H-H that is parallel with a horizontal axis of the cover 805. The slope angle $\theta_2$ is measured as the angle between a line C-C, which is tangent with the slope of the annular inner sidewall 825 at the location 862 adjacent the drink opening 822, the line H-H that is parallel with the horizontal. As shown, slope angle $\theta_1$ is less than the slope angle $\theta_2$. In some examples, the slope angle $\theta_1$ of the portion comprising the printed text 852 may be between about 10° and about 25°. In some examples, the slope angle may be between about 15° and about 20°, for example, about 16° or about 17°. On the opposite side of the cover 805, the slope angle $\theta_2$ is greater than $\theta_1$, such that the descent from the inner peripheral edge 824 of the annular upper ridge 820 is steeper than that on the opposing side of the cover 805. In some examples, the slope angle $\theta_2$ may be between about 30° and about 45°. In some examples, the slope angle may be between about 38° and about 43°, for example, about 40° or about 41°. It is believed that this configuration of a slope angle $\theta_2$ provides improved drinkability out of the drink hole. That is, the slope angle $\theta_2$ of the annular inner sidewall 825 adjacent the drink opening 822 provides a less obstructed flow path as the cup is tipped to pour fluid, which in turn allows for a smoother, less turbulent flow of fluid toward the drink opening 822. This can provide a smoother, and more satisfactory sip for a user, and be less likely to result in an unexpected rush of fluid from the drink opening 822, or undesired leaking or dribbling from the lid assembly 805.

The drink opening 822 is formed in the annular upper ridge 820 of the cover, and can be formed as a slot or hole, and be configured to allow contents within a cup to be poured through the lid assembly 805. As shown in the side view of FIG. 10 and the cross-sectional view of FIG. 16 of the cover, the drink opening 822 is positioned in a higher location relative to the mounting portion 810 as compared to the opposing side of the cover 805. This is a result of the annular upper ridge 820 forming an angled surface that extends along an axis B-B (FIG. 10) that is angled with respect to the axis A-A of the annular mounting portion 810, such that the annular upper ridge 820 slopes downward from the drink opening 822 toward the opposing side 860. That is, the distance between the annular upper ridge 822 and the annular mounting portion 810 at the drink opening 822 is greater than the distance between the annular upper ridge 820 and the annular mounting portion 810 along the opposing portion 860 of the annular upper ridge 820. Additionally, as seen in FIGS. 12 and 13, the width of the annular upper ridge 820 (i.e., the distance between the outer peripheral edge 823 and the inner peripheral edge 824) is greater at the drink opening 822 as compared to the location 860 opposite the drink opening. This sloped upper ridge 820 configuration may provide an aesthetic appearance, and it may also allow the annular inner sidewall 825 to achieve a desired slope or angle at which to present the printed text 852.

The cap 807 includes a main body 850 that fits within the interior portion 835 of the cover 805. The cap 807 has an outer perimeter 851 with a shape that corresponds with the shape of the outer periphery 951 of the interior portion 835 of the cover. In this way, when the cap 807 is attached to the cover 805, the outer periphery 951 of the cover and the outer perimeter 851 of the cap form a single visible line, as opposed to two separate lines, thereby offering a cleaner and more aesthetically pleasing appearance. This is shown, for example, in the assembled lid assembly 800 of FIG. 8.

In some formats, the cap 807 and the cover 805 can be formed from a common sheet of material, and will thus have a common thickness. However, in other formats, the cap 807 and cover 805 can be formed from different sheets of material, and may be formed from different materials altogether. This will allow the cap 807 and the cover 805 to have different thicknesses, as necessary to achieve different objectives. For instance, in some situations, it may be beneficial to provide a cover 805 that is formed from a thicker base material so as to provide greater structural stability, whereas the cap 807 can be formed from a thinner material to allow for greater flexibility or movement of the flap 840, for example. In other situations, the opposite may be more valuable. For instance, it may be useful in some situations to provide a cover of a thinner material, to allow the cover greater flexibility to attach or connect to a particular cup. Forming the two components from separate sheets of material allows for flexibility in the design of both components.

As shown in FIG. 14, the flap 840 is pivotally connected to the main body 850 of the cap 807 at a hinge 842. The flap 840 pivots between the open and closed positions about the hinge 842. A plug 845 is arranged at an end of the flap 840 and is configured to fit within the drink opening 822 of the cover 805 in a closed position, thereby closing and/or sealing the drink opening. The flap 840 may also include a tab 843 extending from a distal end of the flap 840 to facilitate gripping of the flap. When the flap 840 is in the closed position, the tab 843 may extend beyond the outer peripheral edge 823 of the upper ridge 820 of the cover 805. The tab 843 provides a gripping surface that helps a user to grasp or flick the flap 840 and move it between open and closed positions.

The cap 807 includes a main body 850 that fits within the interior portion 835 of the cover 805. The cap 807 has an outer perimeter 851 that has a shape that corresponds with the shape of the outer periphery 951 of the interior portion 835 of the cover. In this way, when the cap 807 is attached to the cover 805, the outer periphery 951 of the cover and the outer perimeter 851 of the cap form a single visible line, as opposed to two separate lines, thereby offering a cleaner and more aesthetically pleasing appearance.

The interior portion 835 of the cover 805 covers the area defined within the tapered sidewalls 825. The interior portion 835 defines an upper surface 902, a groove 905*a*, and a well 910*a*. The cap 807 is configured to fit snugly over the interior portion 835 of the cover and has many of the same features of the interior portion 835 of the cover 805 so that the cap 807 nests over the interior portion 835. For example, the cap 807 includes an upper surface 870 that generally covers the interior portion 835 of the cover 807. In some configurations, the main body 850 of the cap 807 is defined by an outer periphery 851 that corresponds with the shape of the outer periphery 951 of the interior surface 835 of the cover 805. The cap 807 also includes a corresponding groove 805*b* that is configured to nest within the groove 805*a* in the cover 805, and a well 910*b* configured to nest within the well 910*a* of the cover 805.

The grooves 905*ab* generally extend around the periphery of the interior portion 835 of the cover 805 and the cap 807, respectively, and terminate at opposite sidewalls of the respective wells 910*ab*. The groove 905*a* in the cover 805 may have a depth of about ⅛" relative to the upper surface 902, and an interior shape configured to complement the corresponding outside shape of the groove 905*b* of the cap 807. The depth of the groove is merely exemplary and may be adjusted as necessary. More specifically, when viewed from below (see FIG. 11), the groove 905*a* corresponds to a ridge or protrusion 906 that extends below the cap 807. The interior sidewalls of the groove 905*a* of the cover 805 may have a negative draft angle of about 3 to 7 degrees that match corresponding positive draft angles of the ridge. Other draft angles may be suitable. While the illustrated grooves 905*ab* extend around most of the respective peripheries, it is understood that the grooves 905*ab* may extend to a lesser amount or that the grooves 905*ab* may not extend by the same amount. For example, the groove 905*a* in the cover 805 may extend around the periphery as illustrated, while the groove 905*b* in the cap 807 may extend around the cap 807 to a lesser degree, or be formed of segmented sections that fit within the groove 805*a* of the cover 805. Other configurations are contemplated.

The respective wells 910*ab* have a width and depth sized to receive the flap 840 of the cover 807. A second post 915*b* extends upwardly from the bottom surface of the well 910*b* defined in the cap 807. When viewed from the bottom (see FIG. 11), the inner side of the second post 915*b* forms a cavity 916 that is configured to receive and form a friction fit with the first post 915*a* on the cover 805. The second post 915*b* is also configured to fit within a cavity defined the backside of the plug 845 (see FIG. 14) disposed at the end of the flap 840 to secure the flap 840 in an open position. In some implementations, the cover 805 may define a corresponding protrusion 915*a* configured to nest within the protrusion 915*b* of the cap 807. The centralized location of the post 915*a* on the cover and the corresponding second post 915*b* on the cap helps secure the cap 807 to the cover 805, as it adds another friction fitting that holds and secures the cap 807 on the cover 805. This added frictional support can inhibit the cap 807 from detaching from the cover 805 as a result of tension forces applied from the flap 804 to the cap 807 after periodic movement of the flap 840 between open and closed positions.

The interior portion 835 of the cover 505 also includes a small opening 917*a* to facilitate equalization of pressure within the drink cup when the lid assembly 800 is attached to the cup. A corresponding opening 917*b* may be provided in the cap 807. The respective openings 917*ab* may be aligned to provide an unobstructed passage between the space within the cup and the atmosphere outside of the cup. In other configurations, the respective openings 917*ab* may be offset from one another (e.g., on opposing sides of the lid assembly 800 as shown in FIG. 9), to provide an impeded flow path between the openings 917*ab* to inhibit the unwanted leakage of fluid from the cup through the openings 917*ab*.

As seen in FIGS. 8 and 9, and 14, the cap 807 includes printed text 852 on an upper surface 870 of the cap. The printed text 852 includes branding text 852*b* and informational text 852*c* that identifies the particular cup size that the lid assembly 800 is designed to cooperate with (e.g., 20 or 24 ounce cups). Like the warning text 852*a* on the cover, the printed text portions 852*bc* on the cap 807 are formed as deformations in the material forming the cap 805. Because the posts 915*ab* are positioned in a centralized location (e.g., positioned in a middle area of the lid assembly, positioned on or about the center) with respect to the lid assembly, the flap 840 will operate between open and closed positions essentially within one half (i.e., the drinking half) of the lid assembly 800. This allows for the printed text 852 on the side of the cap opposite the drink opening 822 to remain generally uncovered and unobstructed from view in both the open and closed configuration of the flap 840. Further, providing the centralized post 915*ab* in a central location (e.g., at the center of the lid assembly itself), allows for a flap that is relatively short, in particular, with respect to lids that place a post away from the center, in a location on the lid opposite the drink opening. Users may find that a shorter flap 840 is easier to toggle between the open and closed positions because the distance between the two positions is relatively short. For example, a user may be able to move the flap 840 with a simple flick of a finger on a hand that is holding the cup. That is, the user may be able to move the flap 840 without having to either let go of the cup, and without involving the use of a second hand. This can be particularly useful to users that do not have a second hand available (e.g., users drinking a beverage while driving, or holding other objects, etc.). Moreover, the shorter flap will be less likely to interfere with a user during the drinking process. That is, a longer flap, if left unsecured may flop down on top of a user's nose as a user tilts the cup to drink a beverage, which can be annoying and distracting to the user. The shorter flap 840, on the other hand, even if left unsecured, may be too short to significantly interfere with a user's face, even if the flap 840 is unsecured.

In some implementations, the lid assemblies described in this application are stackable with other similar lid assemblies. For example, lid assembly 800 may nest with other similar lid assemblies 800 such that multiple lid assemblies 800 nested together occupy less space than the individual un-nested lid assemblies 800 would occupy collectively. This can be particularly useful for packaging, shipping, and presenting the lid assemblies prior to installation on a cup. In some formats, the tab 843 extending from the flap 840 of the cap 807 can affect the stackability of the lid assemblies 800. That is, if the tab 843 extends too far out from the annular upper ridge 820 of the cup, the outer annular sidewall 815 of another stacked lid may inhibit the ability of the lid assemblies 800 to nest with one another, thereby resulting in a nested stack of lid assemblies 800 that occupies more space than necessary. To help improve stackability, the outer annular sidewall 815 of the lid assembly at the drink opening 822 includes a rounded, or parabolic shaped configuration, as shown in the cross-sectional view of the cover 805 in FIG. 16. This rounded configuration allows a tab 843 of the flap 840 that extends a distance from the outer peripheral edge 823 of the upper ridge 820 to bend downward and tuck between the outer annular sidewalls 815 of two nested lid assemblies without significantly affecting stackability.

Many other modifications may be made to adapt a particular situation or material to the teachings without departing from its scope. Therefore, it is intended that the present method and system not be limited to the particular embodiment disclosed, but that the method and system include all embodiments falling within the scope of the appended claims.

The present disclosure describes preferred embodiments and examples of lid assemblies. Those skilled in the art will recognize that a wide variety of modifications, alterations, and combinations can be made with respect to the above described embodiments without departing from the scope of the invention as set forth in the claims, and that such modifications, alterations, and combinations are to be viewed as being within the ambit of the inventive concept. In addition, it should also be understood that features of one embodiment may be combined with features of other embodiments to provide yet other embodiments as desired. All references cited in the present disclosure are hereby incorporated by reference in their entirety.

We claim:

1. A lid assembly comprising:

a cover configured to attach to a top rim of a cup surrounding a cup opening, the cover including:

an annular mounting portion configured to receive the top rim of the cup and secure the cover thereto;

an annular upper ridge defined between an inner peripheral edge and outer peripheral edge, the annular upper ridge having a drink opening;

an annular outer sidewall extending upward from the mounting portion to the outer peripheral edge of the annular upper ridge;

an interior portion having an outer periphery; and an annular inner sidewall having a surface that slopes downward and inward from the inner peripheral edge of the annular upper ridge to the outer periphery of the interior portion; and a cap removably attachable to the cover, the cap comprising:

a main body configured to attach to and cover at least part of the interior portion of the cover; and a flap extending from the main body, the flap including a plug at an end of the flap, the plug configured to pivot between open and closed positions, and to be inserted into and seal the drink opening in the closed position, wherein the annular inner sidewall comprises readable indicia on the sloped surface, the readable indicia extending along a portion of the annular inner sidewall that is opposite the drink opening, wherein a slope angle of the portion of the annular inner sidewall comprising readable indicia differs from a slope angle of the annular inner sidewall adjacent the drink opening, wherein the slope angle is defined by the angle between an axis tangent to the annular inner sidewall and a horizontal axis of the cover, and wherein the slope angle of the portion of the annular inner sidewall that comprises the readable indicia is between about 10° and about 25°.

2. The lid assembly of claim 1, wherein the slope angle of the annular inner sidewall portion adjacent the drink opening is between about 30° and about 45°.

3. A lid assembly comprising:

a cover configured to attach to a top rim of a cup surrounding a cup opening, the cover including:

an annular mounting portion configured to receive the top rim of the cup and secure the cover thereto;

an annular upper ridge defined between an inner peripheral edge and outer peripheral edge, the annular upper ridge having a drink opening;

an annular outer sidewall extending upward from the mounting portion to the outer peripheral edge of the annular upper ridge;

an interior portion having an outer periphery; and an annular inner sidewall having a surface that slopes downward and inward from the inner peripheral edge of the annular upper ridge to the outer periphery of the interior portion; and a cap removably attachable to the cover, the cap comprising:

a main body configured to attach to and cover at least part of the interior portion of the cover; and a flap extending from the main body, the flap including a plug at an end of the flap, the plug configured to pivot between open and closed positions, and to be inserted into and seal the drink opening in the closed position, wherein the annular inner sidewall comprises readable indicia on the sloped surface, the readable indicia extending along a portion of the annular inner sidewall that is opposite the drink opening, wherein the interior portion of the cover comprises a first post and the main body of the cap comprises a second post that defines a cavity on an underside of the cap, wherein the first post is configured to fit within the cavity to facilitate securing the cap to the cover, and wherein the second post is configured to form a securable connection with the plug at the end of the flap, and wherein the main body of the cap comprises readable indicia between the second post and an edge of the cap opposite the flap.

4. A lid assembly comprising:

a cover configured to attach to a top rim of a cup surrounding a cup opening, the cover including:

an annular mounting portion configured to receive the top rim of the cup and secure the cover thereto;

an annular upper ridge defined between an inner peripheral edge and outer peripheral edge, the annular upper ridge having a drink opening;

an annular outer sidewall extending upward from the mounting portion to the outer peripheral edge of the annular upper ridge;

an interior portion having an outer periphery; and an annular inner sidewall having a surface that slopes downward and inward from the inner peripheral edge of the annular upper ridge to the outer periphery of the interior portion; and a cap removably attachable to the cover, the cap comprising:

a main body configured to attach to and cover at least part of the interior portion of the cover; and a flap extending from the main body, the flap including a plug at an end of the flap, the plug configured to pivot between open and closed positions, and to be inserted into and seal the drink opening in the closed position, wherein the annular inner sidewall comprises readable indicia on the sloped surface, the readable indicia extending along a portion of the annular inner sidewall that is opposite the drink opening, wherein the interior portion of the cover comprises a first post and the main body of the cap comprises a second post that defines a cavity on an underside of the cap, wherein the first post is configured to fit within the cavity to facilitate securing the cap to the cover, wherein the second post is configured to form a securable connection with the plug at the end of the flap, and wherein the flap in the open position is configured to be secured to the second post without covering any of the readable indicia on the cap.

5. A lid assembly comprising:

a cover configured to attach to a top rim of a cup surrounding a cup opening, the cover including:

an annular mounting portion configured to receive the top rim of the cup and secure the cover thereto;

an annular upper ridge defined between an inner peripheral edge and outer peripheral edge, the annular upper ridge having a drink opening;

an annular outer sidewall extending upward from the mounting portion to the outer peripheral edge of the annular upper ridge;

an interior portion having an outer periphery; and an annular inner sidewall having a surface that slopes downward and inward from the inner peripheral edge of the annular upper ridge to the outer periphery of the interior portion; and a cap removably attachable to the cover, the cap comprising:

a main body configured to attach to and cover at least part of the interior portion of the cover; and a flap extending from the main body, the flap including a plug at an end of the flap, the plug configured to pivot between open and closed positions, and to be inserted into and seal the drink opening in the closed position, wherein the annular inner sidewall comprises readable indicia on the sloped surface, the readable indicia extending along a portion of the annular inner sidewall that is opposite the drink opening, and wherein the cover and the cap are formed from materials having different thicknesses.

6. The lid assembly of claim 5, wherein a slope angle of the portion of the annular inner sidewall comprising readable indicia differs from a slope angle of the annular inner sidewall adjacent the drink opening, wherein the slope angle is defined by the angle between an axis tangent to the annular inner sidewall and a horizontal axis of the cover.

7. The lid assembly of claim 5, wherein the readable indicia is formed by a deformation in the cover.

8. The lid assembly of claim 7, wherein the readable indicia forms at least one of an embossed or a raised marking, and is formed by at least one of a molding, engraving, or stamping process.

9. The lid assembly of claim 5, wherein the flap is configured so that it does not obscure the readable indicia in when the flap is in either the open position or the closed position.

10. The lid assembly of claim 5, wherein the interior portion of the cover comprises a first post and the main body of the cap comprises a second post that defines a cavity on an underside of the cap, wherein the first post is configured to fit within the cavity to facilitate securing the cap to the cover, and wherein the second post is configured to form a securable connection with the plug at the end of the flap.

11. The lid assembly of claim 5, wherein the annular upper ridge includes an inclined surface between the inner and outer peripheral edges thereof that extends transversely with respect to a horizontal plane defined by the cup opening, such that the distance between the inclined surface of the annular upper ridge and the annular mounting portion at the drink opening is greater than the distance between the inclined surface of the annular upper ridge and the annular mounting portion adjacent the portion of the annular inner sidewall comprising the readable indicia.

12. The lid assembly of claim 5, wherein the annular upper ridge has a width between the inner and outer peripheral edges that is greater at the drink opening than along the portion of the annular upper ridge opposite the drink opening.

13. The lid assembly of claim 5, wherein the main body of the cap is defined by an outer perimeter, the outer perimeter defining a shape that corresponds with that of the outer periphery of the interior portion of the cover such that the cap covers substantially the entire interior portion of the cover when the cap is attached to the cover.

14. The lid assembly of claim 5, wherein the interior portion of the cover includes a cap mounting groove and a recessed well portion, wherein the cap mounting groove extends around the outer periphery of the interior portion and terminates adjacent opposite sidewalls of the recessed well portion, and wherein the main body of the cap includes a corresponding projection and a well portion that complement the cap mounting groove and recessed well portion of the interior portion of the cover so that the main body nests over the interior portion of the cover when the cap is mounted to the cover with the projection received within the cap mounting groove.

15. A lid assembly comprising:

a cover configured to attach to a top rim of a cup surrounding a cup opening, the cover including:

an annular mounting portion configured to receive the top rim of the cup to secure the cover thereto;

an annular upper ridge defined between an inner peripheral edge and an outer peripheral edge, the annular upper ridge having a drink opening;

an annular outer sidewall extending upward from the mounting portion to the outer peripheral edge of the annular upper ridge;

an interior portion having an outer periphery; and an annular inner sidewall circumscribing the interior portion, the annular inner sidewall sloping downward and inward between inner peripheral edge of the annular upper ridge and the outer periphery of the interior portion; and a cap removably attachable to the cover comprising:

a main body configured to attach to and cover at least part of the interior portion of the cover; and a flap pivotally extending from the main body, the flap including a plug at an end of the flap, the plug configured to be inserted into and seal the drink opening, wherein interior portion of the cover comprises a first post and the main body of the cap comprises a second post that defines a cavity on an underside of the cap, wherein the first post is configured to fit within the cavity when the cap is secured to the cover, wherein the second post is configured to form a securable connection with the plug at the end of the flap for holding the flap in an open position away from the drink opening, and wherein the first post is positioned in a centralized location of the cover.

16. The lid assembly of claim 15, wherein the main body of the cap is defined by an outer perimeter, the outer perimeter defining a shape that corresponds with that of the outer periphery of the interior portion of the cover such that the cap covers substantially the entire interior portion of the cover when the cap is attached to the cover.

17. A lid assembly comprising:

a cover configured to attach to a top rim of a cup surrounding a cup opening, the cover including:

an annular mounting portion configured to receive the top rim of the cup to secure the cover thereto;

an annular upper ridge defined between an inner peripheral edge and an outer peripheral edge, the annular upper ridge having a drink opening;

an annular outer sidewall extending upward from the mounting portion to the outer peripheral edge of the annular upper ridge;

an interior portion having an outer periphery; and an annular inner sidewall circumscribing the interior portion, the annular inner sidewall sloping downward and inward between inner peripheral edge of the annular upper ridge and the outer periphery of the interior portion; and a cap removably attachable to the cover comprising:

a main body configured to attach to and cover at least part of the interior portion of the cover; and a flap pivotally extending from the main body, the flap including a plug at an end of the flap, the plug configured to be inserted into and seal the drink opening, wherein interior portion of the cover comprises a first post and the main body of the cap comprises a second post that defines a cavity on an underside of the cap, wherein the first post is configured to fit within the cavity when the cap is secured to the cover, wherein the second post is configured to form a securable connection with the plug at the end of the flap for holding the flap in an open position away from the drink opening, and wherein the first post is positioned at the center of the cover.

18. A lid assembly comprising:

a cover configured to attach to a top rim of a cup surrounding a cup opening, the cover including:

an annular mounting portion configured to receive the top rim of the cup to secure the cover thereto;

an annular upper ridge defined between an inner peripheral edge and an outer peripheral edge, the annular upper ridge having a drink opening;

an annular outer sidewall extending upward from the mounting portion to the outer peripheral edge of the annular upper ridge;

an interior portion having an outer periphery; and an annular inner sidewall circumscribing the interior portion, the annular inner sidewall sloping downward and inward between inner peripheral edge of the annular upper ridge and the outer periphery of the interior portion; and a cap removably attachable to the cover comprising:

a main body configured to attach to and cover at least part of the interior portion of the cover; and a flap pivotally extending from the main body, the flap including a plug at an end of the flap, the plug configured to be inserted into and seal the drink opening, wherein interior portion of the cover comprises a first post and the main body of the cap comprises a second post that defines a cavity on an underside of the cap, wherein the first post is configured to fit within the cavity when the cap is secured to the cover, wherein the second post is configured to form a securable connection with the plug at the end of the flap for holding the flap in an open position away from the drink opening, and wherein the main body of the cap comprises readable indicia between the second post and a peripheral edge of the cap side opposite the flap.

19. The lid assembly of claim 18, wherein the flap is configured to secure to the second post without covering the readable indicia on the cap.

* * * * *